US005983911A

United States Patent [19]

Steele

[11] Patent Number: 5,983,911

[45] Date of Patent: Nov. 16, 1999

[54] DEVICE TO ASSIST A PERSON TO SIT AND STAND WHILE MAINTAINING THEIR BALANCE

[76] Inventor: Richard B. Steele, 506 Plymouth La., Schaumburg, Ill. 60193

[21] Appl. No.: 08/938,682

[22] Filed: May 26, 1997

[51] Int. Cl.[6] ..... A61H 3/00

[52] U.S. Cl. ..... 135/66; 135/67; 297/5

[58] Field of Search ..... 135/66, 67, 74, 135/69, 75; 297/5, 6

[56] References Cited

U.S. PATENT DOCUMENTS

| | | | |
|---|---|---|---|
| D. 326,250 | 5/1992 | Oliver . | |
| 3,232,251 | 2/1966 | Hughes | 135/67 X |
| 3,272,530 | 9/1966 | Klassen | 297/5 X |
| 4,111,445 | 9/1978 | Haibeck | 297/5 X |
| 4,474,202 | 10/1984 | Belchner . | |
| 4,700,730 | 10/1987 | Samuelson et al. . | |
| 4,844,107 | 7/1989 | Watkins . | |
| 4,869,279 | 9/1989 | Hedges . | |
| 4,987,622 | 1/1991 | Shockey | 5/61 X |
| 4,987,912 | 1/1991 | Taylor . | |
| 5,005,599 | 4/1991 | Cunningham . | |
| 5,217,032 | 6/1993 | Jobst . | |
| 5,273,063 | 12/1993 | Farr et al. . | |
| 5,449,013 | 9/1995 | Landers . | |
| 5,460,394 | 10/1995 | Novi | 135/67 X |
| 5,465,744 | 11/1995 | Browning . | |
| 5,509,152 | 4/1996 | Kippes | 135/67 X |
| 5,509,432 | 4/1996 | Peterson . | |
| 5,647,602 | 7/1997 | Nevin | 297/5 X |

FOREIGN PATENT DOCUMENTS

| | | | |
|---|---|---|---|
| 1373085 | 11/1974 | United Kingdom | 297/5 |

*Primary Examiner*—Carl D. Friedman
*Assistant Examiner*—Winnie S. Yip
*Attorney, Agent, or Firm*—Meroni & Meroni

[57] ABSTRACT

A device resting on a floor surface for enhancing the self-mobility of a person comprises a base structure comprised of a plurality of floor rail stabilizers and a base platform. The plurality of floor rail stabilizers include parallel sides. The base platform is comprised of a base frame and a base plate fixably attached to the base frame with the base frame having parallel side surfaces and being fixably attached in flush surface-to-surface relation to the plurality of floor rail stabilizers for strength and stability. The base platform is located and positioned between the plurality of floor rail stabilizers for holding the device to the floor surface. A plurality of upright side stands are sized and positioned on the floor rail stabilizers for sustaining and transferring a lateral force applied by the person. Each upright side stand is comprised of a plurality of vertical rail members and a plurality of angled rod members. Each upright side stand is located and positioned with each angled rod member positioned in a direction toward the back end of the corresponding floor rail stabilizer to provide stability and each vertical rail member thereby transferring the lateral force to the corresponding angled rod member. Each angled rod member thereby transfers the lateral force to the corresponding floor rail stabilizer to resist tipping and to relieve the corresponding vertical rail member of stress.

23 Claims, 12 Drawing Sheets

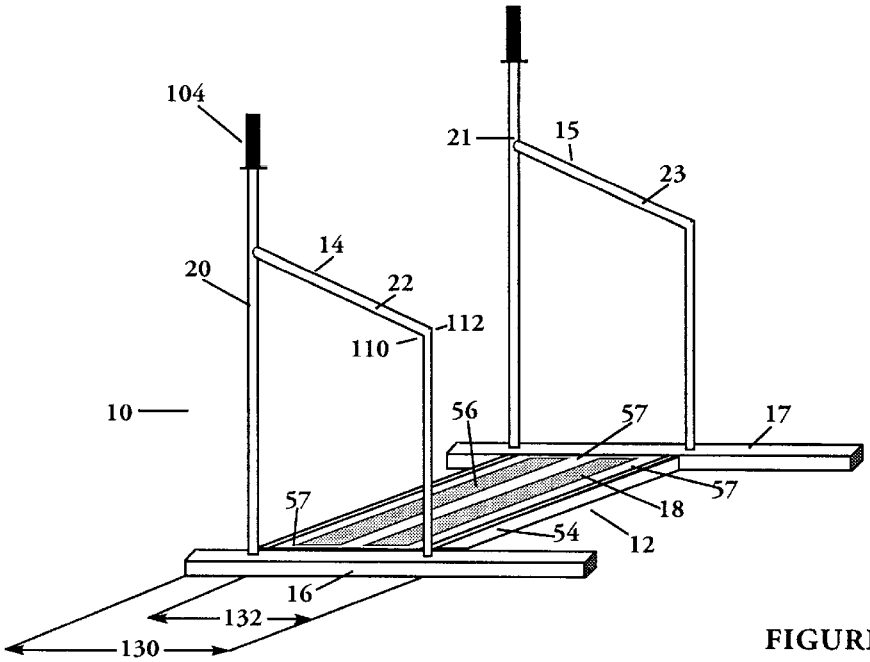
FIGURE 1
FIGURE 2
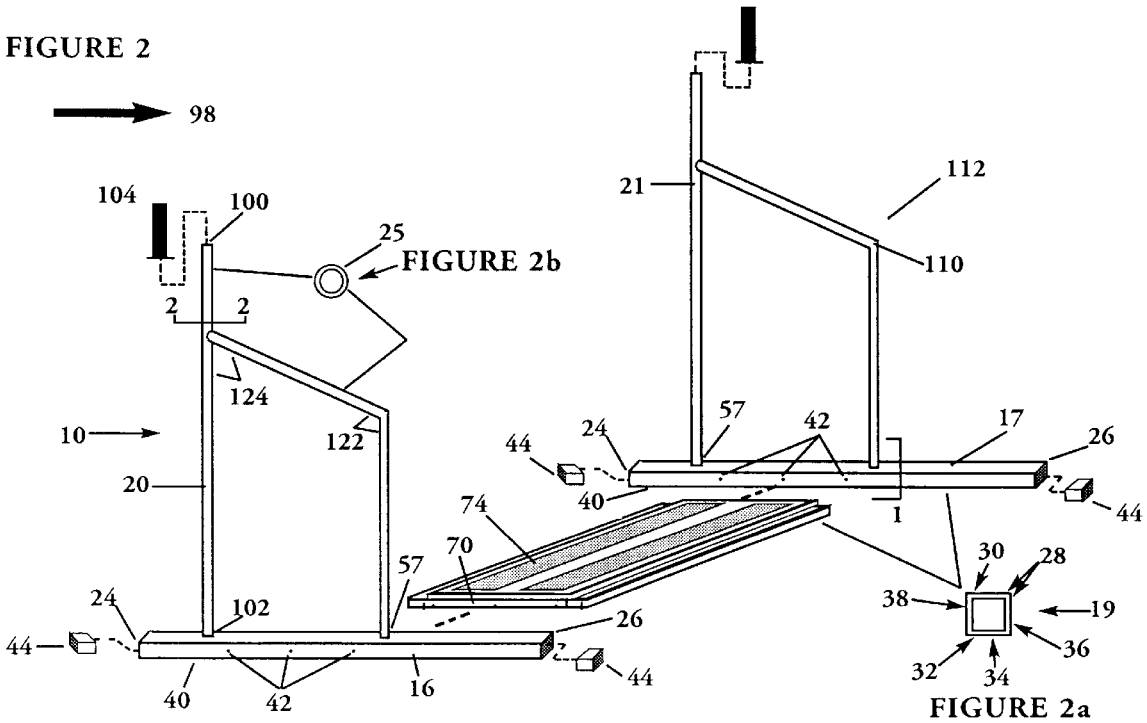
FIGURE 2a

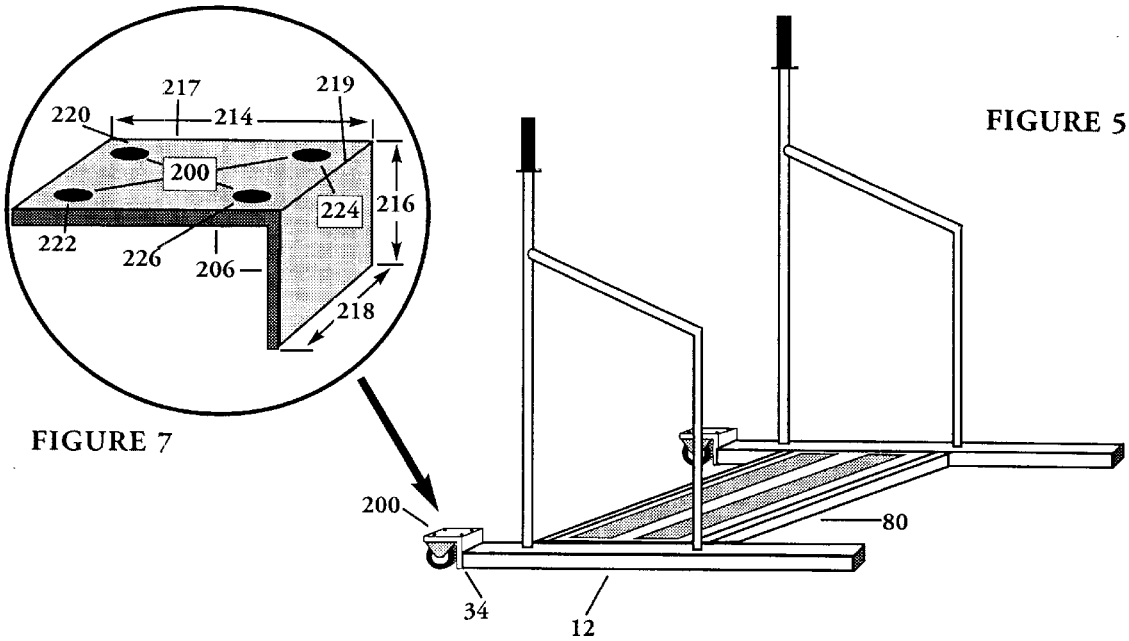
FIGURE 5
FIGURE 7
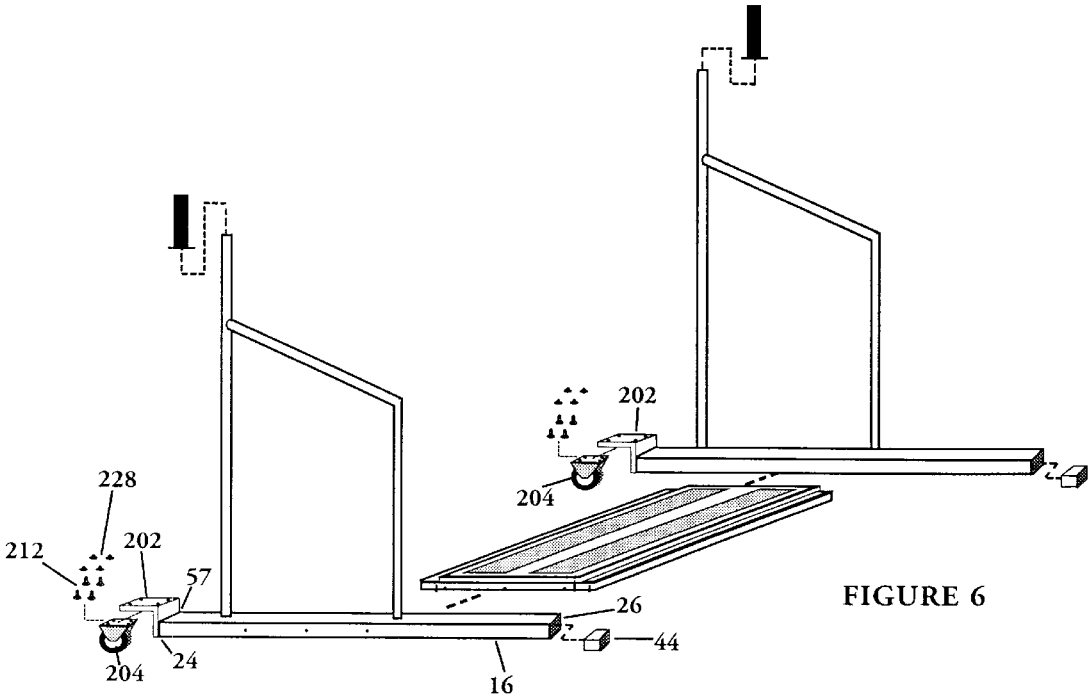
FIGURE 6

DEVICE TO ASSIST A PERSON TO SIT AND STAND WHILE MAINTAINING THEIR BALANCE

BACKGROUND OF THE INVENTION

1. Field of the Invention

My invention relates generally to mechanical aids and methods that enhance the self-mobility of a person, especially physically challenged individuals. More particularly, the invention pertains to an improved device for assisting the person in safely rising from a seated position to a standing position and for assisting the person in safely sitting from a standing position to a seated position without the assistance of a caregiver. My invention also incorporates a therapeutic or fitness feature wherein the person receives the simultaneous benefit of exercise to the arms and legs without causing joint or muscle strain to any muscle group.

2. Description of the Prior Art

The health care industry has experienced a series of transformations and challenges in recent years as it has attempted to cope with an ever increasing population of physically challenged individuals, such as elderly and disabled individuals. These physically challenged individuals have suffered the most under budgetary constraints and they typically live on fixed incomes provided by the U.S. Social Security administration so that they typically lack the significant personal financial resources necessary to pay for sustained private or home health care. Hence, these individuals often spend extensive amounts of time alone and without any form of assisted living provided by other individuals or outside agencies.

A number of prior art devices are found which attempt to provide a means for lifting or hoisting a patient or other incapacitated person from a sitting or prone position, these prior art devices often require the explicit assistance of at least one other caregiver to operate the prior art device and to assist the individual in keeping his or her balance. Some of the prior art devices use motorized or electrically powered features which are often expensive, prone to repair, and do not allow the user to effectively exercise any portion of their physical body which may not be subject to their particular handicap or disablility.

Other prior art devices, such as the devices found in U.S. Pat. Nos. 5,449,013, 5,465,744, and 4,844,107 attempt to assist a disabled person to rise from a seat to a standing position and to assist the disabled person to sit from a standing position. The prior art device in U.S. Pat. No. 5,449,013 requires a brace 18 connecting the forearm supports 14 and 15. The brace 18 can get in the way of the person's feet when using this device. The forearm supports 14 and 15 have a roundish shape which does not transfer a lateral force applied by the user to hand grips 16 and 17 to a floor surface by way of the forearm supports 14 and 15. Thus, the hand grips 16 and 17 bear the lateral force and the device could tip over, hurt the user. Furthermore, a modular construction 50 is contemplated by using a plurality of struts 81 and pins 90. Such construction provides a potential weak point wherein the pins 90 fail in shear while the device is in use and the user again risks injury from a potential fall. The device also discloses the use of round tubular floor rails 12 and 13 which do not provide for a strong, flush welding surface that would add strength and stability to the device.

The adjustable mobility assist device disclosed in U.S. Pat. No. 5,465,744 requires leverage from a stationary object such as a wall or bed. It does not contemplate a device that is self-assisted and that could be used without such stationary objects. Furthermore, this device contemplates the use of four casters 60, 62, 64, and 66 attached to the underside of base 12. This construction could make the device slide easily on the floor surface while in use and could result in the user falling and sustaining injury.

The portable standing and sitting aid or device in U.S. Pat. No. 4,844,107 uses a support arm 5 that is removable from an initial position to assist the user in easily moving the device from room to room. The support arm 5 is received in a slot means 4 and is removably disposed by way of a screw connection or any other easily removable connection. This connection provides a weak point wherein the screw connection could fail and cause the user to fall and sustain injury.

Furthermore, other prior art devices are often bulky, heavy, and incapable of being disassembled and thereby make them unsuitable for home use. In most cases, the individual would be wholly unable to physically move the prior art device around their living quarters and up and down any stairs. Clearly, the purchase of two or more of these prior art devices is a financial impossiblity for most physically challenged individuals and their families. Moreover, an institutional user, such as a hospital or nursing home, would require a conveniently located elevator to transport these prior art devices from floor to floor of the institution as needed or be faced with purchasing a large number of separate prior art devices. In addition, the institutional user may need to use the prior art device on an almost "emergency" basis or risk injury from a potential fall.

At the same time, the fitness equipment industry has experienced an almost unprecedented boom. In particular, the home fitness segment offers health-conscious consumers a wide array of products designed to effectuate exercise and cardiovascular improvement. However, nearly all of the existing products are directed towards users that are essentially already healthy and have the physical mobility to safely operate exercise equipment devices, such as "bike" and "ski" devices. In fact, many of these exercise equipment devices warn certain users to seek medical consultation before beginning use of the device. Clearly, many physicians would be reluctant to allow their physically challenged patients to operate such sophisticated exercise equipment devices. Thus, once again, the disabled, infirm, and handicapped, are likely left without any effective alternatives to exercise those major muscle groups or joints which may not be effected by their particular handicap or disability.

Accordingly, it is a principal object of my invention to provide a lightweight, solid, durable, and completely self-assisted device for physically challenged individuals wishing to safely rise from a seated position or to safely sit from a standing position without the assistance of a caregiver.

Another object of my invention is to provide a device that allows the physically challenged individual to maintain their balance throughout the process of moving from either the seated to a standing position or from a standing to a seated position thereby decreasing the possibility of falling and increasing psychological confidence in the process.

Another object of my invention is to provide a device that allows the physically challenged individual to rise from a seated position or sit from a standing position more quickly and with less effort so that there is less strain on arms, legs, major muscle groups, and joints.

A further object of my invention is to provide a degree of physical exercise to the disabled individual or handicapped user who, without interaction with others, may not otherwise receive such exercise.

Another object of my invention is to provide a portable, mobile device easily capable of being physically moved by a handicapped or disabled.

Other objects of my invention, as well as particular features, elements, and advantages thereof, will be elucidated in, or apparent from, the following description and the accompanying drawing figures. As will be described in greater detail hereinafter, my invention solves all of the aforementioned problems and employs a number of novel features that render it highly advantageous over the prior art.

SUMMARY OF THE INVENTION

According to the features of my invention, I have provided a new and improved device that achieves all of the objects and rests on a floor surface for enhancing the self-mobility of a person comprising: in combination, a base structure comprised of a plurality of floor rail stabilizers and a base platform, the plurality of floor rail stabilizers having parallel sides, the base platform comprised of a base frame and a base plate fixably attached to the base frame, the base frame having parallel side surfaces and being fixably attached in flush surface-to-surface relation to the plurality of floor rail stabilizers for strength and stability, the base platform being located and positioned between the plurality of floor rail stabilizers for holding the device to the floor surface while the person stands upon the base plate and then sits down or stands up, each floor rail stabilizer having a front end and a back end opposite and distal the front end, the base platform located proximate the front end and distal the back end to provide stability, leverage, and to resist tipping, the base structure providing a flat surface for ground engagement; and a plurality of upright side stands being sized and positioned on the base structure for sustaining and transferring a lateral force applied by the person, each upright side stand comprised of a plurality of vertical rail members and a plurality of angled rod members, each vertical rail member having a top end and a bottom end opposite the top end, each angled rod member comprising a first rod portion and a second rod portion connected to the first rod portion by a sharp rod bend, the first rod portion having a first rod end opposite the sharp rod bend, the second rod portion having a second rod end opposite the sharp rod bend, the first rod end located distal the second rod end, the sharp rod bend forming an obtuse angle between the first rod end and the second rod end, the obtuse angle having a value between 110 degrees and 150 degrees, the first rod end fixably attached to the corresponding vertical rail member proximate the top end, the first rod portion diagonally angled forming an acute angle between the first rod portion and the bottom end of the corresponding vertical rail member, the acute angle having a value between 30 degrees and 70 degrees, the second rod portion parallel to the corresponding vertical rail member, the bottom end and the second rod end being fixably and normally attached to the corresponding floor rail stabilizer in flush surface-to-surface relation to provide stability and strength, each upright side stand being located and positioned with each angled rod member positioned in a direction toward the back end of the corresponding floor rail stabilizer to provide stability, each vertical rail member thereby transferring the lateral force to the corresponding angled rod member, each angled rod member thereby transferring the lateral force to the corresponding floor rail stabilizer to resist tipping and to relieve the corresponding vertical rail member of stress.

Another feature of my device comprises: a mobile wheel unit for moving and transporting the device on the floor surface, the mobile wheel unit comprising a plurality of angled brackets and a plurality of casters, each angled bracket being of rigid one-piece construction and having a 90 degree bend in a mid portion to allow for connections, each angled bracket fixably connected in flush surface-to-surface relation to the front end of the corresponding floor rail stabilizer, each angled bracket having a plurality of holes for connections, each caster connected to the angled bracket by the insertion of a plurality of short connectors through the plurality of holes, each caster positioned to lie flush with the flat surface of the base structure thereby resisting movement and ground engagement of the device when the person stands upon the base platform and allowing movement of the device when the person lifts up the back end of the corresponding floor rail stabilizer by pulling the vertical rail member when not standing on the base platform and pushing the device.

A further feature of my device comprises: a tray structure comprised of a tray support stand and a tray operatively connected to the tray support stand, the tray support stand comprised of a plurality of angled tray support members, a plurality of tray support rails, and a plurality of tray support bars, each angled tray support member being of rigid one-piece construction and having a 90 degree bend in a central portion for support placement, each angled tray support member having a first edge and a second edge distal the first edge, each tray support rail comprising an uppermost face and a lowermost face parallel and opposite the uppermost face, an outermost face and an innermost face parallel and opposite the outermost face, and an outer end and an inner end opposite the outer end, the first edge of each angled tray support member fixably attached to the lowermost face proximate the outer end in flush surface-to-surface relation to provide strength and stability, the second edge of each angled tray support member fixably attached to the lowermost face proximate the inner end in flush surface-to-surface relation to provide strength and stability, each tray support bar comprising an inner face and an outer face opposite the inner face, and a first tip and a second tip opposite the first tip, the inner face proximate the first tip of one of the tray support bars being fixably attached in flush surface-to-surface relation to the outermost face of the tray support rail proximate the inner end to provide strength and stability, the inner face proximate the first tip of another one of the tray support bars being fixably attached in flush surface-to-surface relation to the innermost face of the tray support rail proximate the inner end to provide strength and stability, each tray support bar having a connecting hole proximate the second tip and passing through the inner face and the outer face, the tray support stand removably connected to the plurality of upright side stands by placement of each angled tray support on the first rod portion of the corresponding angled rod member, the tray support stand having a gap between the inner faces of the corresponding tray support bars for insertion around the plurality of upright side stands, the corresponding tray support bars connected by tray support connectors to secure the tray support stand to the plurality of upright side stands, the tray comprising an upper plane and a lower plane opposite the upper plane, a front edge and a back edge opposite the front edge, and a plurality of blocks, each block fixably attached to the lower plane proximate the back edge, the plurality of blocks spaced apart to allow each block to removably sit between the corresponding tray support bars in the gap to resist lateral movement of the tray, the lower plane resting on the uppermost face of each tray support rail in flush surface-to-surface relation for stability, the tray removably placed on the tray support stand.

A further feature of my device comprises: the device being downsized proportionately to accomodate a child.

A still further feature of my device comprises: the device being used in a bedroom setting or a dining room setting, the base platform having a front portion running parallel to and being located proximate the corresponding front end of each floor rail stabilizer, the plurality of upright side stands being sized and positioned on the base structure between the corresponding front end of each floor rail stabilizer and the front portion of the base platform to allow the person clearance to laterally move a foot from a first position on the floor surface to a second position onto the base platform without touching the plurality of upright side stands.

BRIEF DESCRIPTION OF THE DRAWINGS

In the drawings:

FIG. 1 is a perspective view of a first and fourth embodiments of my new and improved device for enhancing the self-mobility of a person.

FIG. 2 is an exploded perspective view of the first and the fourth embodiments of the device shown in FIG. 1.

FIG. 2*a* is a cross-sectional view as taken along line 1—1 in FIG. 2 of a floor rail stabilizer of the device.

FIG. 2*b* is a cross-sectional view as taken along line 2—2 in FIG. 2 of a vertical rail member of the device.

FIG. 5 is a perspective view of a second embodiment of the device, a mobile wheel unit.

FIG. 6 is an exploded perspective view of the second embodiment of the device shown in FIG. 5.

FIG. 7 is a perspective view of an angled bracket of the device shown in FIG. 6.

DETAILED DESCRIPTION OF THE PREFERRED EMBODIMENT

Figure 3:
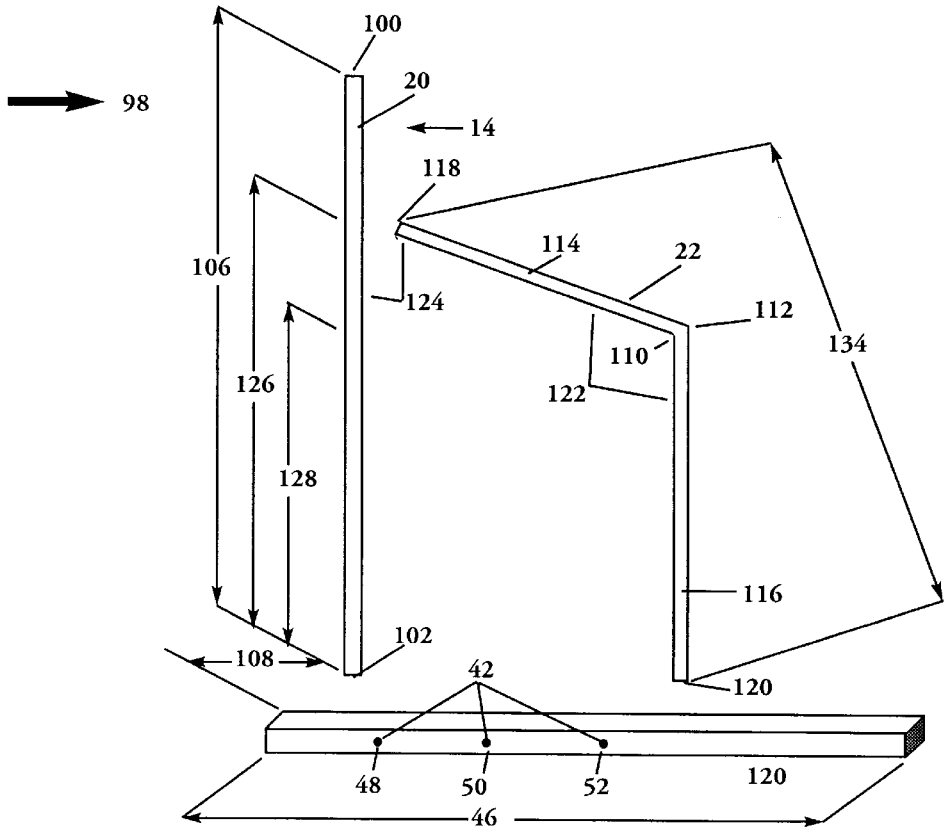
FIG. 3 is an exploded side view of the vertical rail member, an angled rod member, and the floor rail stabilizer of the device shown in FIG. 1.

Referring now to the drawings, my invention provides a new and improved device for enhancing the self-mobility of a person as shown in FIG. 1. FIG. 1 shows a first embodiment of my invention, the device 10, in combination comprising: a base structure 12 and a plurality of upright side stands 14 and 15. The base structure 12 comprises: a plurality of floor rail stabilizers 16 and 17 and a base platform 18. The plurality of upright side stands 14 and 15 comprises: a plurality of vertical rail members 20 and 21 and a plurality of angled rod members 22 and 23. In other embodiments, the plurality of angled rod members 22 and 23 are a plurality of diagonally disposed rod members.

The device 10 is constructed of solid steel, preferably 16 gauge steel, for strength and rigidity, is coated with a protective coating, preferably baked powder coating, and is lightweight, preferably thirty to thirty-two pounds. As shown in FIG. 1 the device 10 is also completely self-assisted because it can be used without the assistance of a wall, chair, bed and so forth.

As shown in FIG. 2, the plurality of floor rail stabilizers 16 and 17 has a front end 24, a back end 26 opposite and distal the front end 24 inorder to provide the device 10 with stability, and parallel sides 28 (shown in cross-section in FIG. 2*b*). The parallel sides 28 comprise a top side 30, a bottom side 32 parallel and opposite the top side 30, the bottom side 32 providing a bottom flat surface 34 for ground engagement and stability, an outer side 36, and an inner side 38 parallel and opposite the outer side 36. The plurality of floor rail stabilizers 16 and 17 have a non-skid bottom surface 40 to allow the device 10 to be used on any type of floor surface. The plurality of floor rail stabilizers 16 and 17 are constructed of square and hollow uniform cross-sectioning 19, as shown in FIG. 2*a*, to provide for a flush, surface-to-surface fitting in attachments which in turn provides stronger welding surfaces and provides maximum strength of construction and stability. Each floor rail stabilizer 16 and 17 has a plurality of holes 42 running through the parallel sides 28 proximate the front end 24 for attachment purposes. The plurality of holes 42 runs through the outer side 36 and the inner side 38. In addition, a plug cap 44 is inserted into each front end 24 and each back end 26 to provide smooth surfaces and safety.

In the preferred embodiment of the first embodiment, as shown in FIG. 3, the plurality of floor rail stabilizers 16 and 17 (not shown) have a length 46 measuring 34 inches to provide stability and to resist tipping of the device 10. The plurality of holes 42 is three 5/16 inch holes, each hole drilled on center. A center of one hole 48 being located 10 7/16 inches from the front end, a center of a second hole 50 being located 15 inches from the front end 24 and 19 inches from the back end 26, and a center of a third hole 52 being located 14 7/16 inches from the back end 26. Each floor rail stabilizer 16 and 17 being 7/8 inch square steel tubing.

Figure 4:
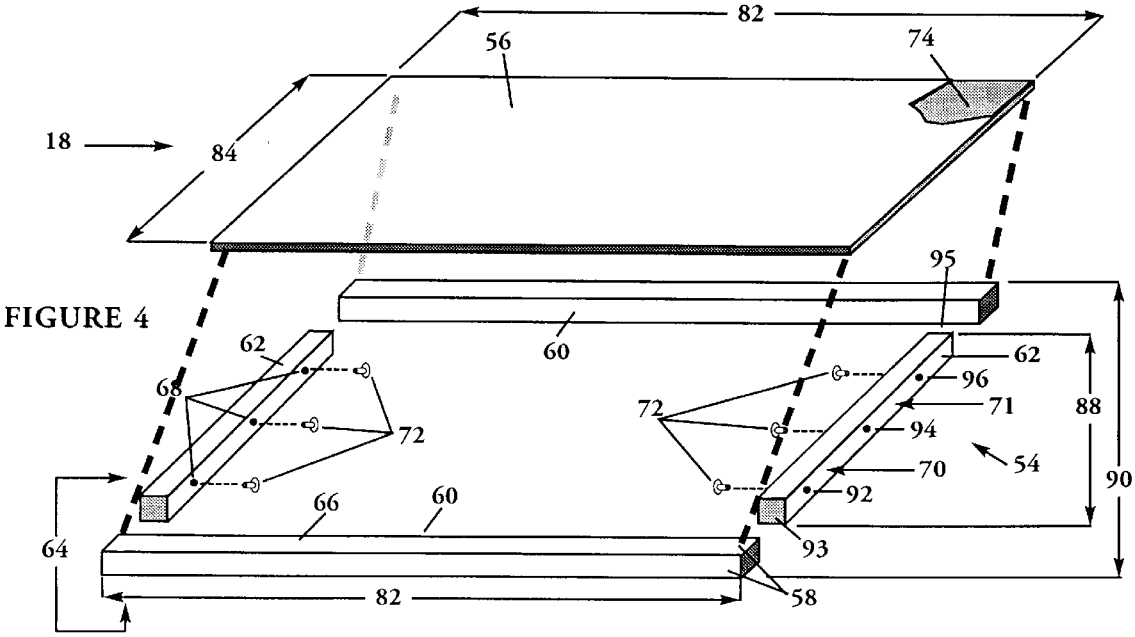
FIG. 4 is an exploded perspective view of a base platform of the device shown in FIG. 1 showing connectors used to fixably attach the base platform to each floor rail stabilizer.

The base platform 18, as shown in FIGS. 1 and 4, is comprised of a base frame 54 and a base plate 56 fixably attached to the base frame 54. The base frame 54 has parallel side surfaces 58, which in other embodiments is a plurality of side surfaces. The base frame 54 is fixably attached in flush surface-to-surface relation to the plurality of floor rail stabilizers 16 and 17 for strength and stability and to provide stronger welding surfaces. This attachment is accomplished by the fixed attachment of one of the side surfaces 70 to the inner side 38 of each corresponding floor rail stabilizer 16 and 17. The base frame 54 has substantially similar square and hollow uniform cross-sectioning 19 as has the plurality of floor rail stabilizers 16 and 17, as shown in FIG. 2*a*, inorder to provide the proper attachment, welding surfaces, and the stability and strength.

Furthermore, in the preferred embodiment of the first embodiment as shown in FIGS. 1 and 4, the base frame 54 comprises: a plurality of long rails 60 and a plurality of short rails 62 welded 57 to the plurality of long rails 60 in normal and flush surface-to-surface relation for maximum strength and stability. The plurality of long rails 60 runs parallel to each other and perpendicular to the plurality of short rails 62. The base frame 54 has a rectangular shape 64 and an upper face 66. Each short rail 62 has a plurality of connection holes 68 and a short rail surface 71. The base plate 56 is welded to the upper face 66 to provide strength and stability. The short rail surface 71 is the side surface 58 which is fixably attached in flush surface-to-surface relation to the corresponding floor rail stabilizer 16 and 17 by connectors 72 which are inserted through the plurality of connection holes 68 and into the plurality of holes 42 where they are then welded 57 to the corresponding floor rail stabilizer 16 and 17, as shown in FIGS. 1, 2, and 4. The base plate 56 also has a non-skid upper surface 74 as shown in FIG. 2.

Figure 16:
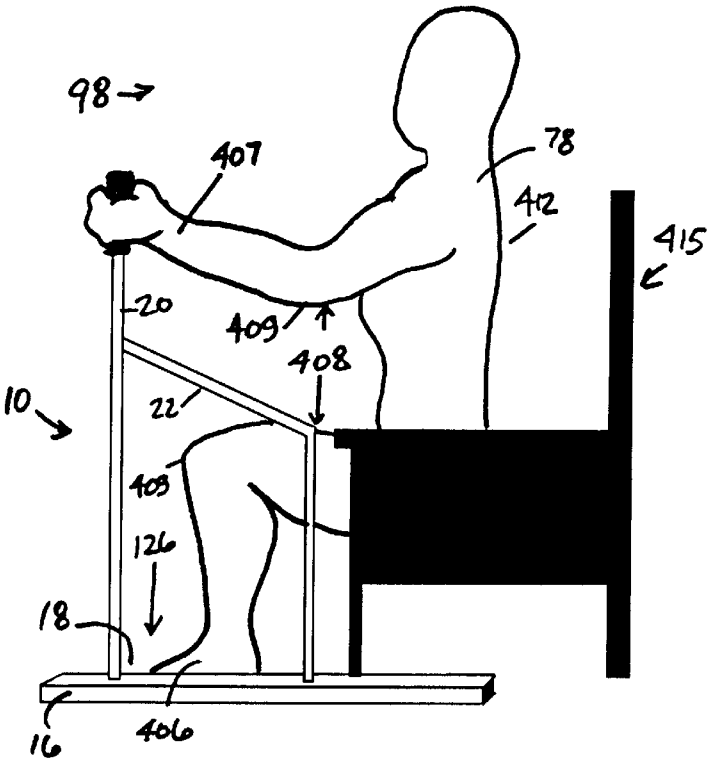
FIG. 16 is a side view illustrating a person utilizing the first or fourth embodiments of the device with a chair, the person rising from the chair.
Figure 17:
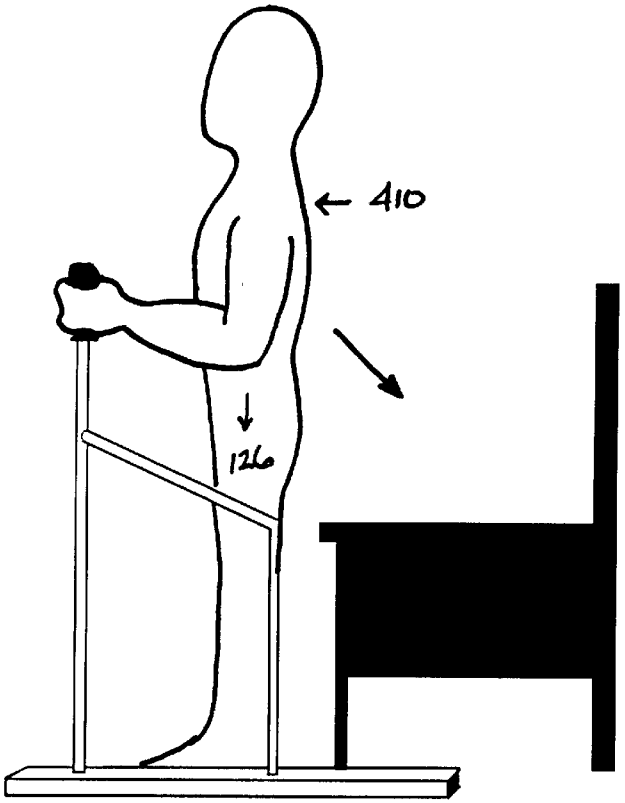
FIG. 17 is a side view illustrating the person utilizing the first or fourth embodiments of the device with the chair, the person sitting on the chair.

In addition, the base platform 18 is located and positioned between the plurality of floor rail stabilizers 16 and 17 inorder to hold the device 10 to a floor surface 76 while a person 78 stands upon the base plate 56 and then uses the device 10 to sit down or stand up as shown in FIGS. 16 and 17. In addition, the base platform 18 is located proximate the front end 24 and distal the back end 26 of the plurality of floor rail stabilizers 16 and 17 to provide stability, leverage against the floor surface 76, and to resist tipping of the device 10 while in use. Thus, the device 10 is completely self-assisted and does not require the use of a wall, chair, and so forth for leverage. The base structure 12 provides a flat surface 80 for ground engagement as shown in FIG. 16.

Also in the preferred embodiment of the first embodiment, as shown in FIG. 4, the base plate 56 is a 1/8 inch thick steel plate having a length 82 measuring 26 1/8 inches, and a width 84 measuring 12 inches. The long rail 60 has a length 86 of 27 inches and the short rail 62 has a length 88 of 11 7/8 inches. The plurality of long rails 60 and the plurality of short rails 62 are all constructed of 7/8 inch steel square tubing as shown in FIG. 4. The base frame 54 has a width 90 of 12 7/8 inches. The plurality of connection holes 68 of each short rail 62 is three 3/8 inch holes, each drilled on center. A center of one hole 92 being located 1 inch from a first end 93 of the corresponding short rail 62, a second hole 94 being located 5 9/16 inches from the first end 93 of the corresponding short rail 62, and the third hole 96 being located 1 inch from a second end 95 of the corresponding short rail 62. The base plate 56 is welded 57 on top of the base frame 54 to the upper face 66 and leaves a 7/16 inch inset on all sides. Additionally as shown in FIG. 4, the connectors 72 are six 1/4-20 weldnuts that are inserted through the plurality of connection holes 68 on the inside of the base frame 54 and through the plurality of holes 42 where they are then welded 57 for added strength. Both sides of the connection are preferably flat for safety purposes.

The plurality of upright side stands 14 and 15, shown in FIGS. 1, 2, and 3 (wherein upright side stand 15 is not shown), is sized and positioned on the base structure 12 for sustaining and transferring a lateral force 98 applied by the person 78. Each upright side stand 14 and 15 has a round and hollow uniform cross-sectioning 25 to provide maximum strength and stability and is constructed of solid steel as shown in FIG. 2*b*. As shown in FIGS. 2 and 3 each vertical rail member 20 and 21 (not shown in FIG. 3) has a top end 100 and a bottom end 102 opposite the top end 100. The bottom end 102 is fixably and normally attached in flush surface-to-surface relation to the top side 30 of the corresponding floor rail stabilizer 16 and 17 (not shown in FIG. 3) proximate the front end 24 to provide maximum strength and stability against the lateral force 98. Each vertical rail member 20 and 21 is also constructed of solid steel and has a round and hollow uniform cross-sectioning 25, as shown in FIG. 2*b*, to provide maximum strength and stability. A hand grip 104, as shown in FIGS. 1 and 2, is attached to each top end 100 of the plurality of vertical rail members 20 and 21 and the hand grip 104 can be a soft padded, comfort grip, a bicycle grip, or the like.

In the preferred embodiment of the first embodiment, as shown in FIG. 3, each vertical rail member 20 and 21 (not shown) has a length 106 of 37 inches and is located a distance 108 of 8 inches from the front end 24 of the corresponding floor rail stabilizer 16 and 17 so as to provide stability against tipping of the device 10. Each vertical rail member 20 and 21 is constructed of 7/8 inch round steel tubing.

The plurality of angled rod members 22 and 23 or plurality of diagonally disposed rod members, as shown in FIGS. 1, 2, and 3 (angled rod member 23 not shown in FIG. 3) are a key feature to the transfer of the lateral force 98 from the person 78 to the plurality of floor rail stabilizers 16 and 17 and thereby provide stability and strength to the device 10. Each angled rod member 22 and 23 or diagonally disposed rod member is constructed of solid steel and has round and hollow uniform cross-sectioning 25 substantially similar to the cross-sectioning of each vertical rail member 20 and 21, as shown in FIG. 2*b*, and running lengthwise and it is constructed of one-piece solid steel, which has a sharp rod bend 110 in a mid portion 112, as shown in FIGS. 1, 2, and 3.

FIG. 3 shows that each angled rod member 22, 23 or diagonally disposed rod member comprises: a first rod portion 114 and a second rod portion 116 connected to the first rod portion 114 by the sharp rod bend 110. The first rod portion 114 has a first rod end 118 located opposite the sharp rod bend 110 and the second rod portion 116 has a second rod end 120 located opposite the sharp rod bend 110. The first rod end 118 is located distal the second rod end 120. The sharp rod bend 110 forms a critical feature of load transfer. The sharp rod bend 110 forms an obtuse angle 122 between the first rod end 118 and the second rod end 120. The obtuse angle 122 has a value between 110 degrees and 150 degrees inorder to properly transfer the lateral force 98. The first rod end 118 is fixably attached to the corresponding vertical rail member 20 and 21 proximate the top end 100 by means of welds 57, as shown in FIG. 2, and the like which provide strength and stability.

The first rod portion 114 is diagonally angled to form an acute angle 124 between the first rod portion 114 and the bottom end 102 of the corresponding vertical rail member 20 and 21 as shown in FIGS. 2 and 3. The acute angle 124 has a value between 30 degrees and 70 degrees. The second rod portion 116 is positioned parallel the corresponding vertical rail member 20 and 21. The second rod end 120 extends normally from the top side 30 and is fixably and normally attached in flush surface-to-surface relation to the top side 30 of the corresponding floor rail stabilizer 16 and 17 proximate the back end 26 to provide maximum strength and stability. Attachments being made by welds 57 and the like to provide maximum strength, stability, and transfer of the lateral force 98. In addition, each angled rod member 22 and 23 or diagonally disposed rod member is positioned in a direction toward the back end 26 of the corresponding floor rail stabilizer 16 and 17 to provide stability. The above mentioned structuring and construction transfers the lateral force 98 applied by the person 78 in the following manner as shown in FIG. 16: the person 78 transferring the lateral force 98 to each vertical rail member 20 and 21 which then transfers the lateral force 98 to the corresponding angled rod member 22 and 23, each angled rod member 22 and 23 thereby transferring the lateral force 98 to the corresponding floor rail stabilizer 16 and 17. The construction transferring the lateral force 98 and the person's 78 weight 126 to the base structure 12 and the floor surface 76. The transferring of the lateral force 98 thereby resists tipping and relieves the corresponding vertical rail member 20 and 21 of stress. The base plate 56 is located and positioned between each upright side stand 14 and 15, (i.e. each vertical rail member 20 and 21, and each angled rod member 22 and 23 or each diagonally disposed rod member) for maximum stability.

In the preferred embodiment of the first embodiment, as shown in FIGS. 1, 2, and 3 the acute angle 124 has a value of 45 degrees for maximum transfer of the lateral force 98 and the obtuse angle 122 has a value of 135 degrees. Also in the preferred embodiment as shown in FIG. 3, the first rod end 118 is attached to the corresponding vertical rail member 20 and 21 at a height 126 of 27 inches from the top side 30. The sharp rod bend 110 is located at a height 128 of 13 inches from the top side 30. The second rod end 120 is located a distance 130 of 22 inch from the front end 24 and 12 inches from the back end 26, the bottom end 102 having a distance 132 of 14 inches from the second rod end 120 so as to cover the base platform 18 and to distribute the lateral force 98 and provide stability. Each angled rod member 22 and 23 or each diagonally disposed rod member is constructed of ⅞ inch round steel tubing and has a length 134 of 32½ inches.

Figure 8:
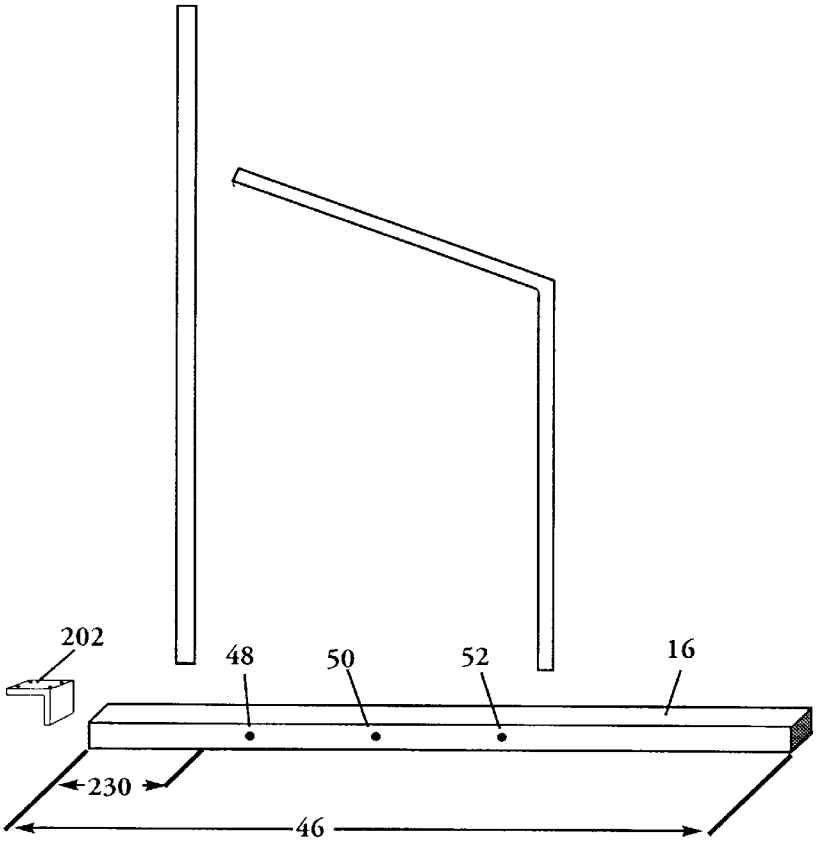
FIG. 8 is an exploded side view of the vertical rail member, the angled rod member, the angled bracket, and the floor rail stabilizer of the device shown in FIG. 6.

In a second embodiment of my invention, as shown in FIG. 5, a mobile wheel unit 200 for moving and transporting the device 10 on the floor surface 76 is provided at the front end 24 of each corresponding floor rail stabilizer 16 and 17. The mobile wheel unit 200 comprises: a plurality of angled brackets 202 and a plurality of casters 204. Each angled bracket 202 is made of rigid one-piece construction and has a 90 degree bend 206 in a mid portion 208 to allow for connections as shown in FIG. 7. Each angled bracket 202 is fixably connected in flush surface-to-surface relation to the front end 24 of the corresponding floor rail stabilizer 16 and 17 by a weld 57 or the like as shown in FIGS. 5, 6, and 8. The plug cap 44 is inserted only into the back end 26 of the corresponding floor rail stabilizer 16 and 17 (not shown in FIG. 8). Each angled bracket 202 has a plurality of holes 210 for connections and each caster 204 is connected to the angled bracket 202 by the insertion of a plurality of short connectors 212 through the plurality of holes 210. Each caster 204 is positioned to lie flush with the flat surface 80 of the base structure 12 and bottom flat surface 34 of the plurality of floor rail stabilizers 16 and 17 thereby resisting movement and ground engagement of the device 10 when the person 78 stands upon the base platform 18 and allowing movement of the device 10 when the person 78 lifts up the back end 26 of a floor rail stabilizer 16 and 17 by pulling the vertical rail member 20 and 21 when not standing on the base platform 18 and then by pushing the device 10.

In the preferred embodiment of the second embodiment, as shown in FIG. 6, each caster 204 will not damage hard wood floor surfaces and the like and is a Bassick caster. Each angled bracket 202, as shown in FIG. 7, is constructed of ⅛ inch steel plate having length 214 of 3 inches, a height 216 of 2½ inches, and a width 218 of 2 inches. The plurality of holes 210 is four 5/16 inch holes. A first hole 220 is located 5/16 inch from an outer end 215 and ½ inch from an inner end 217, a second hole 222 is located 5/16 inch from the outer end 215 and 1½ inch from the inner end 217, a third hole 224 is located 5/16 inch from an inner edge 219 and ½ inch from the inner end 217, and a fourth hole 226 is located 5/16 inch from the inner edge 219 and 1½ inch from the inner end 217. Each short connector 212, as shown in FIG. 6, is a short bolt or the like that is inserted through the caster 204 upwards and through one of the plurality of holes 210 and is then capped by a cap nut 228 to provide a safe and smooth surface. In the second embodiment, as shown in FIG. 8, the floor rail stabilizer 16 and 17 (not shown) has the length 46 measuring 30 inches and the distance 230 between the angled bracket 202 and the bottom end 102 of the corresponding vertical rail member 20 and 21 (not shown) is 4 inches. The plurality of holes 210 of the corresponding floor rail stabilizer 16 and 17 (not shown) are constructed as in the first embodiment. The center of the one hole 48 is located 6 7/16 inches from the front end 24, the center of the second hole 50 being located 11 inches from the front end 24 and 19 inches from the back end 26, and the center of the third hole 52 being located 14 7/16 inches from the back end 26.

Figure 9:
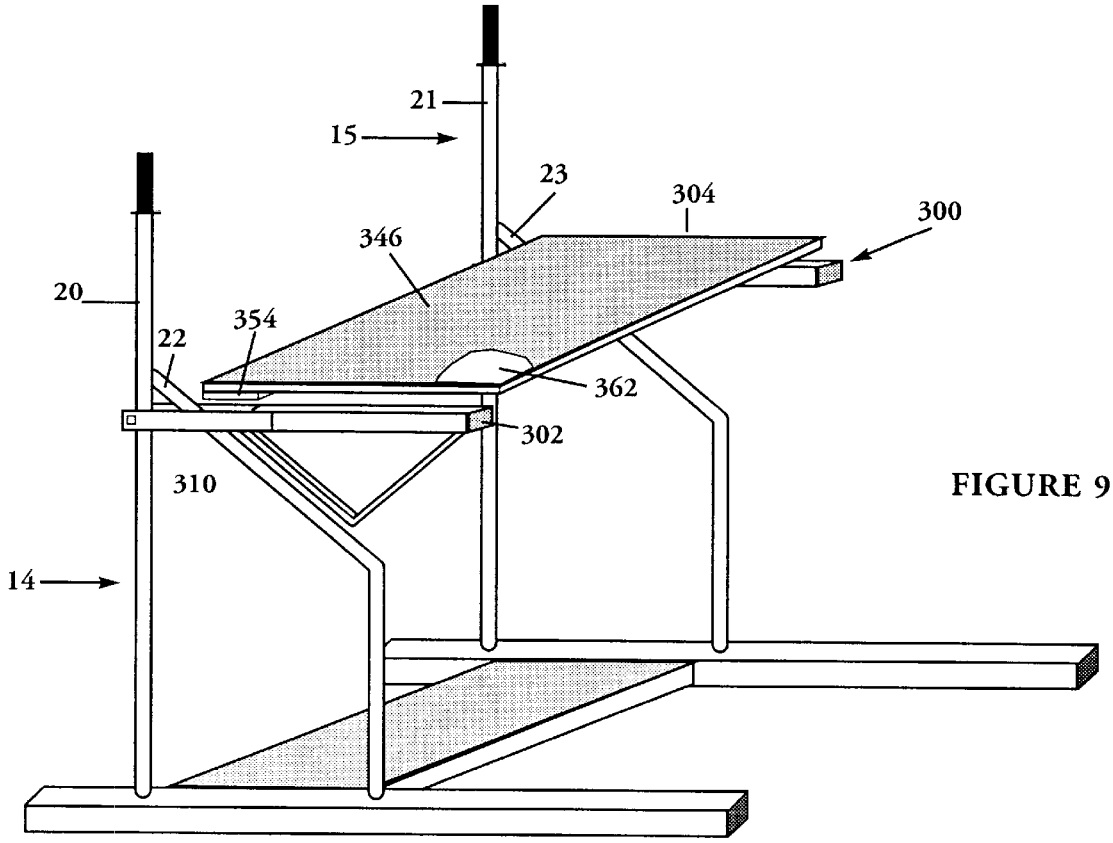
FIG. 9 is a perspective view of a third embodiment of the device, a tray structure removably connected to the device.
Figure 10:
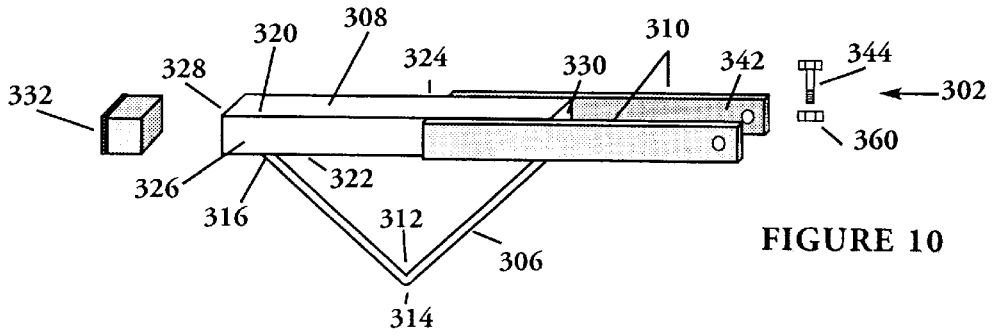
FIG. 10 is a perspective view of a tray support stand and a tray support connector of the device shown in FIG. 9.

In FIG. 9, a third embodiment of my invention is shown, a tray structure 300, comprised of a tray support stand 302 and a tray 304 operatively connected to the tray support stand 302. As shown in FIG. 10, the tray support stand 302 is comprised of a plurality of angled tray support members 306, a plurality of tray support rails 308, and a plurality of tray support bars 310. Each angled tray support member 306 is constructed of rigid one-piece construction and has a 90 degree bend 312 in a central portion 314 for support placement. Each angled tray support member 306 also has a first edge 316 and a second edge 318 distal the first edge 316.

Figure 11:
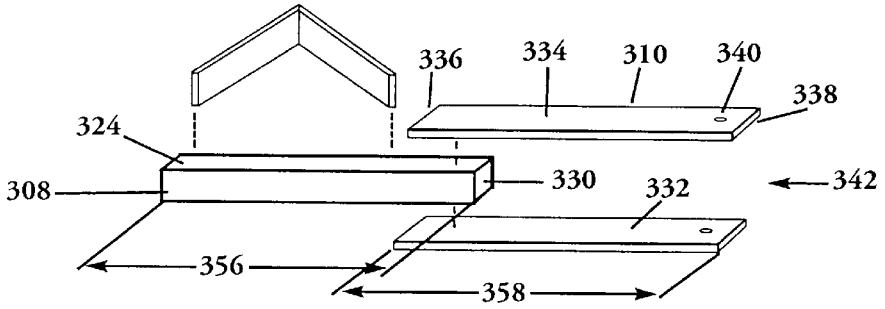
FIG. 11 is an exploded perspective view of the tray support stand in FIG. 10 showing an angled tray support member, a tray support rail, and a tray support bar.

Each tray support rail 308, as shown in FIGS. 10 and 11, comprises: an uppermost face 320 and a lowermost face 322 parallel and opposite the uppermost face 320 an outermost face 324 and an innermost face 326 parallel and opposite the outermost face 324, and an outer end 328 and an inner end 330 opposite the outer end 328. A plug cap 332 is inserted into the outer end 328. The first edge 316 of each angled tray support member 306 is fixably attached, as shown in FIG. 10, to the lowermost face 322 proximate the outer end 328 in flush surface-to-surface relation to provide strength and stability. The second edge 318 of each angled tray support member 306 is fixably attached to the lowermost face 322 proximate the inner end 330 in flush surface-to-surface relation to provide strength and stability.

Each tray support bar 310, as shown in FIGS. 10 and 11, comprises: an inner face 332 and an outer face 334 opposite the inner face 332 and a first tip 336 and a second tip 338 opposite the first tip 336. The inner face 332 is proximate the first tip 336 of one of the tray support bars 310 is fixably attached in flush surface-to-surface relation to the outermost face 324 of the tray support rail 308 proximate the inner end 330 to provide strength and stability. The inner face 332 proximate the first tip 336 of another one of the tray support bars 310 is fixably attached in flush surface-to-surface relation to the innermost face 326 of the tray support rail 308 proximate the inner end 330 to provide strength and stability. Each tray support bar 310 has a connecting hole 340 proximate the second tip 338 and passes through the inner face 332 and the outer face 334.

The tray support stand 302 is removably connected, as shown in FIG. 9, to the plurality of upright side stands 14 and 15 by placement of each angled tray support 306 on the first rod portion 114 of the corresponding angled rod member 22 and 23 or diagonally disposed member. As in FIGS. 10 and 11, the tray support stand 302 has a gap 342 located between the inner faces 332 of the corresponding tray support bars 310 for insertion, as shown in FIG. 9, around the plurality of upright side stands 14 and 15, (i.e. each vertical rail member 20 and 21, and each angled rod member 22 and 23 or each diagonally disposed rod member). The corresponding tray support bars 310 are connected by tray support connectors 344, as shown inf FIG. 10, to secure the tray support stand 302 to the plurality of upright side stands 14 and 15, (i.e. each vertical rail member 20 and 21, and each angled rod member 22 and 23 or each diagonally disposed rod member).

Figure 12:
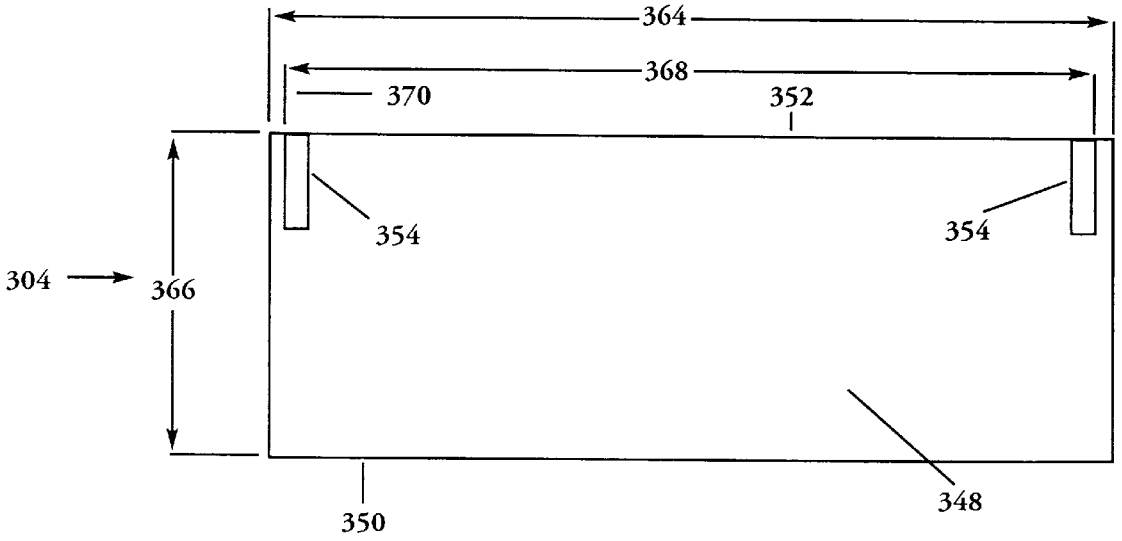
FIG. 12 is a bottom view of a tray of the device shown in FIG. 9 showing a plurality of blocks for operatively connecting the tray to the tray support stand.

The tray 304, as shown in FIGS. 9 and 12, comprises: an upper plane 346 (not shown in FIG. 12) and a lower plane 348 opposite the upper plane 346, a front edge 350 and a back edge 352 opposite the front edge 350, and a plurality of blocks 354. Each block 354 is fixably attached to the lower plane 348 proximate the back edge 352 as shown in FIG. 12. The plurality of blocks 354 are spaced apart to allow each block 354 to removably sit between the corresponding tray support bars 310 in the gap 342, as shown in FIG. 9, to resist lateral movement of the tray 304. The lower plane 348 rests on the uppermost face 320 of each tray support rail 308 in flush surface-to-surface relation for stability. The tray 304 is removably placed on the tray support stand 302 as shown in FIG. 9.

In the preferred embodiment of the third embodiment, as shown in FIG. 9, the third embodiment is to be used on either the first embodiment or on the second embodiment. The tray support stand 302, as shown in FIGS. 10 and 11, is constructed of solid steel for strength, stability, and rigidity. The angled tray support member 310 is ⅛ inch steel bar, 1 inch wide by 17 inches long, bent at the central portion 314 at a 90 degree angle. The tray support rails 308 is a 1 inch square steel tube having a length 356 of 12 inches. Each of the tray support bars 310 is a ⅛ inch steel bar having a ⅞ inch width and a length 358 of 9 inches. The connecting hole 340 is a 5/16 inch hole centered top to bottom a distance of ½ inch from the second tip 338. The tray support connectors 344, as shown in FIG. 10, are ¼×1½ inch bolts that have a nut 360 on the end to screw on for attachment. The plug caps 332, as shown in FIG. 11, are sized to fit the square tray support rails 308. The tray support stand 302 is constructed by welding 57 or the like.

As shown in FIGS. 9 and 12, in the preferred embodiment, the tray 304 is constructed of ¾ inch fiber board and has formica surfaces 362, on the top and edges as shown in FIG. 9. The tray 304 has a length 364 of 30 inches and a width 366 of 18 inches. The blocks 354, as shown in FIG. 12, are two ¾×¾×4½ inch long blocks 354 made of metal, wood, and the like. The blocks 354 are spaced apart a distance 368 of 27 inches and each block 354 is located a distance 370 of ¾ inch from each side of the tray 304 and are glued, screwed, and so forth to the lower plane 348 of the tray 304. The tray 304 is used mainly for eating or writing, though the tray 304 is not to be limited to these uses. The tray structure 300 is to be lightweight for easy installation and removal and is to be easy to clean. The tray 304 fits securely on the tray support stand 302 and can only be removed by lifting the tray 304 off of the tray support stand 302. The tray structure 300 is to sit at about the height of a TV tray.

A fourth embodiment of my invention is the device 10 downsized proportionately to accommodate a child or small adult 77 instead of an adult person 78. The device 10 follows the structure and construction of the first embodiment. In the preferred embodiment of the fourth embodiment as to the plurality of floor rail stabilizers 16 and 17 the length 46 measures 25½ inches to provide stability and to resist tipping of the device 10. As in FIG. 3, the plurality of holes 42 is three 5/16 inch holes, each hole drilled on center. The center of the one hole 48 being located 8¼ inches from the front end 24, the center of the second hole 50 being located 11¼ inches from the front end 24 and 14¼ inches from the back end 26, and the center of the third hole 52 being located 11¼ inches from the back end 26. Each floor rail stabilizer 16 and 17 (not shown) being ⅞ inch square steel tubing.

Also in the preferred embodiment of the fourth embodiment, and following the structure and construction of my first embodiment as shown in FIGS. 2 and 4, the base plate 56 is again ⅛ inch thick steel plate having the length 82 measuring 19⅜ inches and the width 84 measuring 8⅞ inches. Each long rail 60 has the length 86 measuring 20¼ inches and each short rail 62 has the length 88 measuring 8 inches. The plurality of long rails 60 and the plurality of short rails 62 are all constructed of ⅞ inch steel square tubing. As to the base frame 54, the width 90 measures 9¾ inches. The plurality of connection holes 68 of each short rail 62 is three ⅜ inch holes, each drilled on center. The center of one hole 92 being located 1 inch from the first end 93 of the corresponding short rail 62, the second hole 94 being located 3 inches from the first end 93 of the corresponding short rail 62, and the third hole 96 being located 1 inch from the second end 95 of the corresponding short rail 62. The base plate 56 is again welded 57 on top of the base frame 54 to the upper face 66 and leaves a 7/16 inch inset on all sides as shown in FIG. 2. Additionally as shown in FIG. 4, the connectors 72 are six ¼-20 weldnuts that are inserted through the plurality of connection holes 68 on the inside of the base frame 54 and through the plurality of holes 42 where they are then welded 57 for added strength. Both sides of the connection are preferrably flat for safety purposes.

Also in the preferred embodiment of the fourth embodiment, and following the structure and construction of my first embodiment as shown in FIGS. 2 and 3, each vertical rail member 20 and 21 (not shown in FIG. 3) has the length 106 measuring 32 inches and is located at the distance 108 of 6 inches from the front end 24 of the corresponding floor rail stabilizer 16 and 17 (not shown in FIG. 3) so as to provide stability against tipping of the device 10. Each vertical rail member 20 and 21 is constructed of ⅞ inch round steel tubing. The acute angle 124 has a value of 45 degrees for maximum transfer of the lateral force 98 and the obtuse angle 122 has a value of 135 degrees. Also, the first rod end 118 is attached to the corresponding vertical rail member 20 and 21 at the height 126 of 20 inches from the top side 30. The sharp rod bend 110 is located at the height 128 of 9½ inches from the top side 30. The second rod end 120 is located the distance 130 of 16½ inches from the front end 24 and 9 inches from the back end 26, the bottom end 102 having the distance 132 measuring 10½ inches from the second rod end 120 so as to cover the base platform 18 and to distribute the lateral force 98 and to provide stability. Each angled rod member 22 and 23 (not shown FIG. 3) or each diagonally disposed rod member is again constructed of ⅞ inch round steel tubing, but has the length 134 measuring 24⅜ inches.

Figure 13:
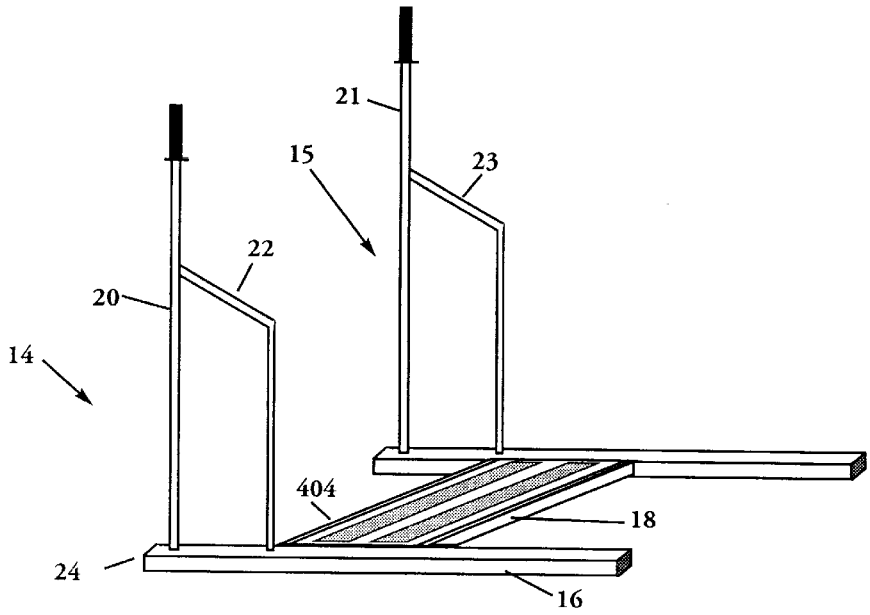
FIG. 13 is a perspective view of a fifth embodiment of the device for use in a bedroom setting or a dining room setting.
Figure 14:
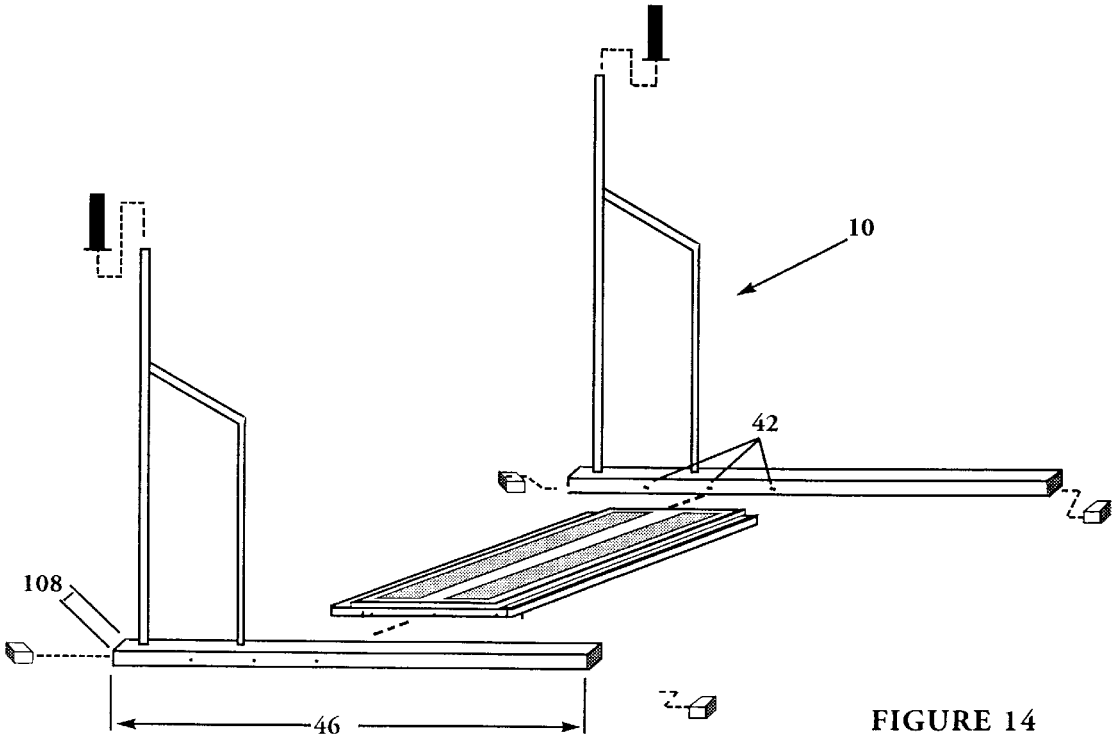
FIG. 14 is an exploded perspective view of the fifth embodiment of the device shown in FIG. 13.
Figure 23:
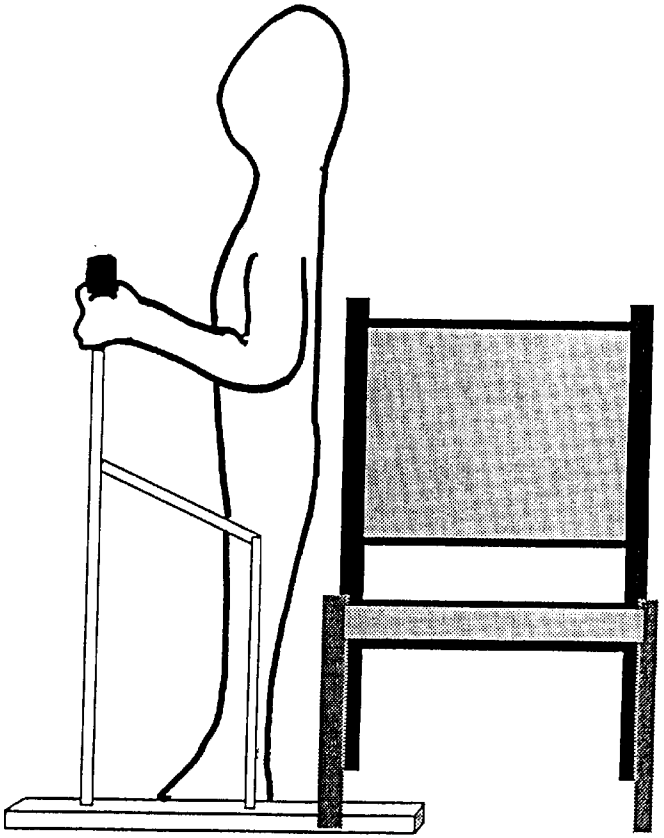
FIG. 23 is a side view illustrating the person utilizing the fifth embodiment of the device with the bed, the person sitting on the bed.
Figure 22:
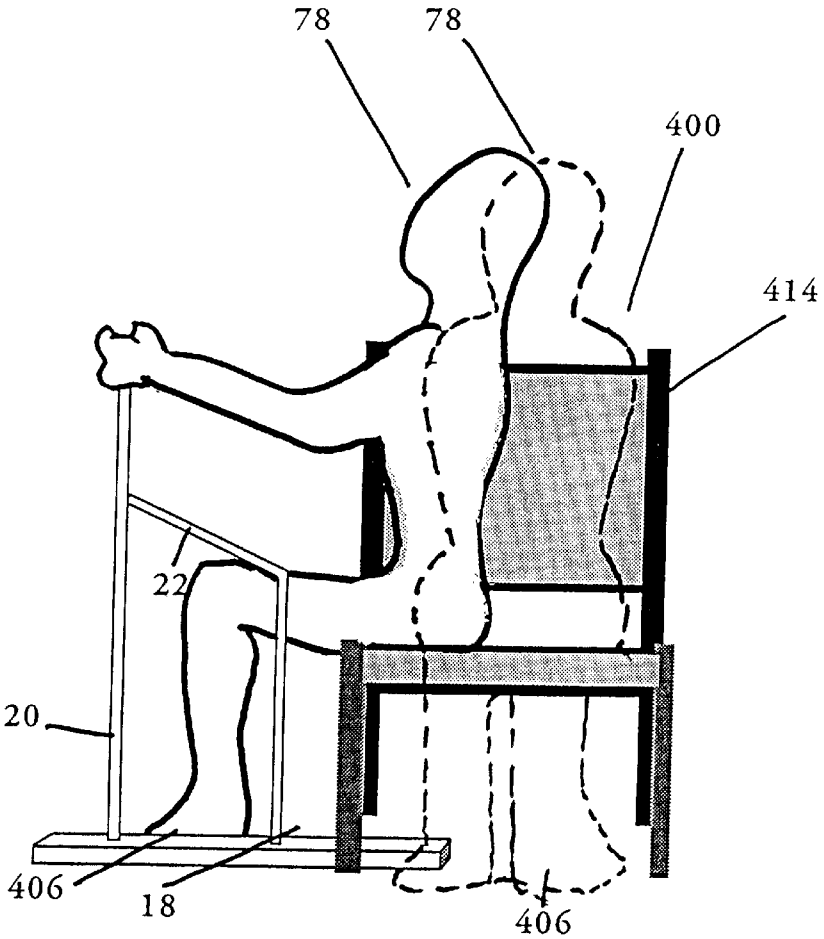
FIG. 22 is a side view illustrating the person utilizing the fifth embodiment of the device with a bed, the person rising from the bed.
Figure 24:
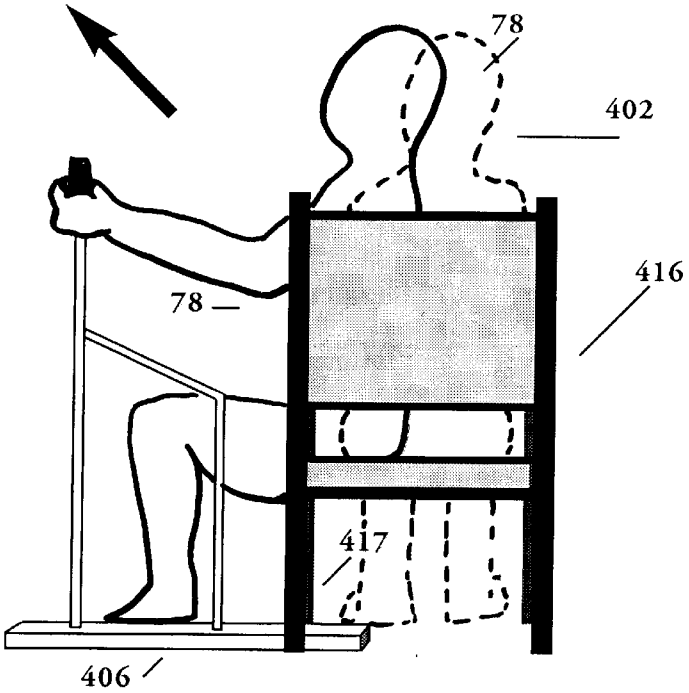
FIG. 24 is a side view illustrating the person utilizing the fifth embodiment of the device with a dining room chair, the person rising from the dining room chair from a side.

In a fifth embodiment of my invention, as shown in FIG. 13, the device 10 is constructed to be used in a bedroom setting 400 or a dining room setting 402, as shown in FIGS. 22–25. In the fifth embodiment, as shown in FIGS. 4 and 14, the base platform 18 has a front portion 404 running parallel to and being located proximate the corresponding front end 24 of each floor rail stabilizer 16 and 17. The plurality of upright side stands 14 and 15 (i.e. plurality of vertical rail members 20 and 21 and the plurality of diagonally disposed rod members 22 and 23) are sized and positioned on the base structure 12 or on the plurality of floor rail stabilizers 16 and 17 between the corresponding front end 24 of each floor rail stabilizer 16 and 17 and the front portion 404 of the base platform 18 to allow the person 78 clearance to laterally move a foot 406 sideways from a first position 420 on the floor surface 76 to a second position 422 onto the base platform 18, as shown in FIGS. 22, 24, and 26 with arrows and the movement of the person 78 in phantom, onto the base platform 18 without touching the plurality of upright side stands 14 and 15 (i.e. the plurality of vertical rail members 20 and 21 and the plurality of diagonally disposed rod members 22 and 23). Each of the plurality of long rails 60 has a shorter dimension equivalent to the length 86, to narrow the base platform 18 and to allow the person 78 easier access to the hand grip 104.

Figure 15:
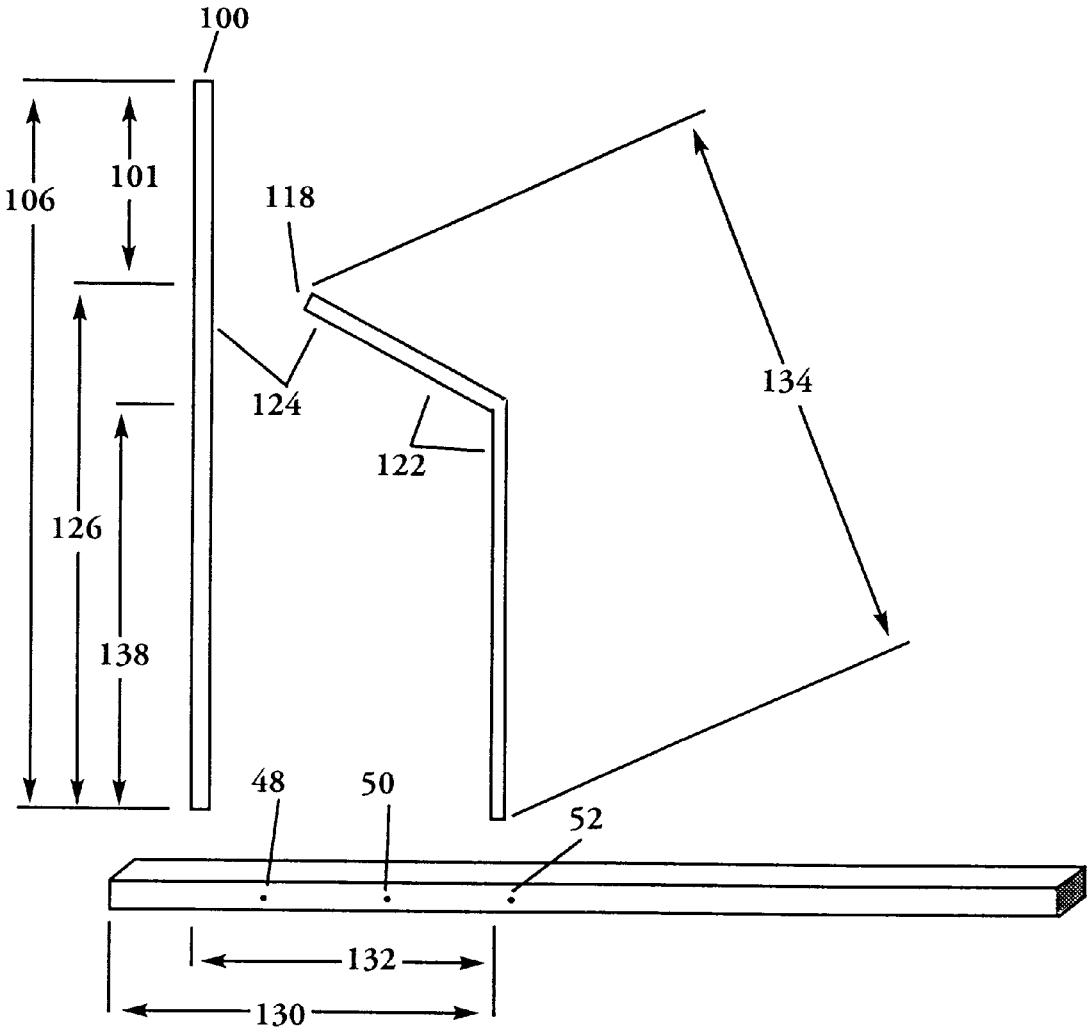
FIG. 15 is an exploded side view of the vertical rail member, an angled rod member, and the floor rail stabilizer of the device shown in FIG. 14.

In the preferred embodiment of the fifth embodiment, as shown in FIGS. 14 and 15, the plurality of floor rail stabilizers 16 and 17 (not shown in FIG. 15) have the length 46 measuring 34 inches to provide stability and to resist tipping of the device 10. The plurality of holes 42 is three 5/16 inch holes, each hole drilled on center. The center of one hole 48 being located 9 inches from the front end 24, the center of the second hole 50 being located 13 9/16 inches from the front end 24 and 20 7/16 inches from the back end 26, and the center of the third hole 52 being located 15⅞ inches from the back end 26. Each floor rail stabilizer 16 and 17 being ⅞ inch square steel tubing.

Also in the preferred embodiment of the fifth embodiment, and following the structure and construction of my first embodiment as shown in FIG. 4, the base plate 56 is a ⅛ inch thick steel plate having the length 82 measuring 23⅛ inches and the width 84 measuring 12 inches. Each long rail 60 has the length 86 measuring 24 inches and the short rail 62 has the length 88 measuring 11⅛ inches. The plurality of long rails 60 and the plurality of short rails 62 are all constructed of ⅞ inch steel square tubing. The base frame 54 has the width 90 measuring 12⅞ inches. The plurality of connection holes 68 of each short rail 62 is three ⅜ inch holes, each drilled on center. The center of one hole 92 being located 1 inch from the first end 93 of the corresponding short rail 62, the second hole 94 being located 5 9/16 inches from the first end 93 of the corresponding short rail 62, and the third hole 96 being located 1 inch from the second end 95 of the corresponding short rail 62. The base plate 56 is welded 57 on top of the base frame 54 to the upper face 66 and leaves a 7/16 inch inset on all sides. Additionally as shown in FIG. 4 , the connectors 72 are six ¼–2¼ connector bolts, weldnuts, and the like that are inserted through the plurality of connection holes 68 on the inside of the base frame 54 and through the plurality of holes 42 where they are then welded 57 for added strength. Both sides of the connection are preferrably flat for safety purposes.

Also in the preferred embodiment of the fifth embodiment, and following the structure and construction of my first embodiment as shown in FIGS. 14 and 15, each vertical rail member 20 and 21 has the length 106 measuring 37 inches and is located the distance 108 of 2 inches from the front end 24 of the corresponding floor rail stabilizer 16 and 17 (not shown in FIG. 15) so as to provide stability against tipping of the device 10. Each vertical rail member 20 and 21 is constructed of ⅞ inch round steel tubing. The acute angle 124 has a value of 45 degrees for maximum transfer of the lateral force 98 and the obtuse angle 122 has a value of 135 degrees. Also, the first rod end 118 is attached to the corresponding vertical rail member 20 and 21 at the height 126 of 27 inches from the top side 30. The sharp rod bend 110 is located at the height 128 of 19 inches from the top side 30. The second rod end 120 is located at the distance 130 of 10 inches from the front end 24 and 24 inches from the back end 26, the bottom end 102 having the distance 132 measuring 8 inches from the second rod end 120 so that clearance is provided for the foot 406 and to transfer the lateral force 98 and provide stability. A distance 101 from the first rod end 118 to the top end 100 is 10 inches. Each angled rod member 22 and 23 (not shown in FIG. 15) or each diagonally disposed rod member is again constructed of ⅞ inch round steel tubing, but has the length 134 measuring 30⅜ inches.

In actual use, as shown in FIGS. 16–26, the device 10 is used to enhance the self-mobility of a person 78. As shown in FIG. 16, the person 78 has weight 126, at least one foot 406 and hand 407, major muscle groups 408, and joints 409. In use of all embodiments the person 78 first places the foot 406, as shown in FIG. 16 (and as applicable to FIGS. 16–26) on a base platform 18 of the device 10 by allowing the person 78 to step through the device 10 without impediment, brace and so forth. Then the person 78 extends the hand 407 and grasps the vertical rail member 20 and 21 of the device 10. The person 78 pulls on the vertical rail member 20 and 21 thereby transferring the lateral force 98 from the hand 407 to the vertical rail member 20 and 21.

Next, the person 78 either rises to a standing position 410 or sits to a seated position 412 (as shown in FIGS. 16–25 by arrows) while pulling on the vertical rail member 20 and 21 thereby imparting the lateral force 98 to the vertical rail member 20 and 21, shifting the weight 126 to the base platform 18 to hold the device 10 on the floor surface 76, and exercising the hand 407, the foot 406, the major muscle groups 408 and the joints 409 in continuous motion without strain. The hand 407 does not need to rest on the corresponding diagonally disposed rod member 22 and 23; to do so could impede the continuous motion and cause discomfort to the person 78.

Next, the device 10 transfers the lateral force 98 from the vertical rail member 20 and 21 to the floor rail stabilizer 16 and 17 by means of the diagonally disposed rod member 22 and 23 thereby resisting tipping of the device 10 and relieving the vertical rail member 20 and 21 of stress.

Finally, the person 78 releases the grasp of the hand 407 on the vertical rail member 20 and 21 after rising to the standing position 410 or sitting to a seated position 412 and after attaining balance. The person 78 thus does not have to let go of the vertical rail member 20 and 21 until they have attained their balance thereby increasing their confidence in the device 10 and in their own abilities. Additionally, the person 78 will not need to transfer their grip on the device 10 while rising or sitting or release the corresponding vertical rail member 20 and 21 prematurely thereby preventing falling and subsequent injury. The device 10 thereby transfers the lateral force 98 of rising or sitting to the floor surface 76 and provides the stability needed to assist the person 78 and to protect the person 78 while using the device 10. The above mentioned method is particularly applicable to the first embodiment and the fourth embodiment which embodies similar structure as discussed above.

Figure 19:
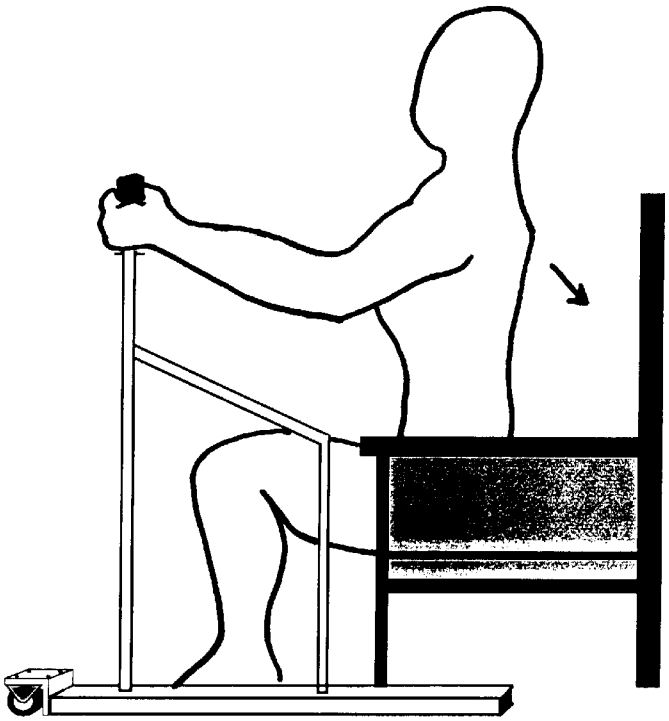
FIG. 19 is a side view illustrating the person utilizing the second embodiment of the device with the chair, the person sitting on the chair.
Figure 18:
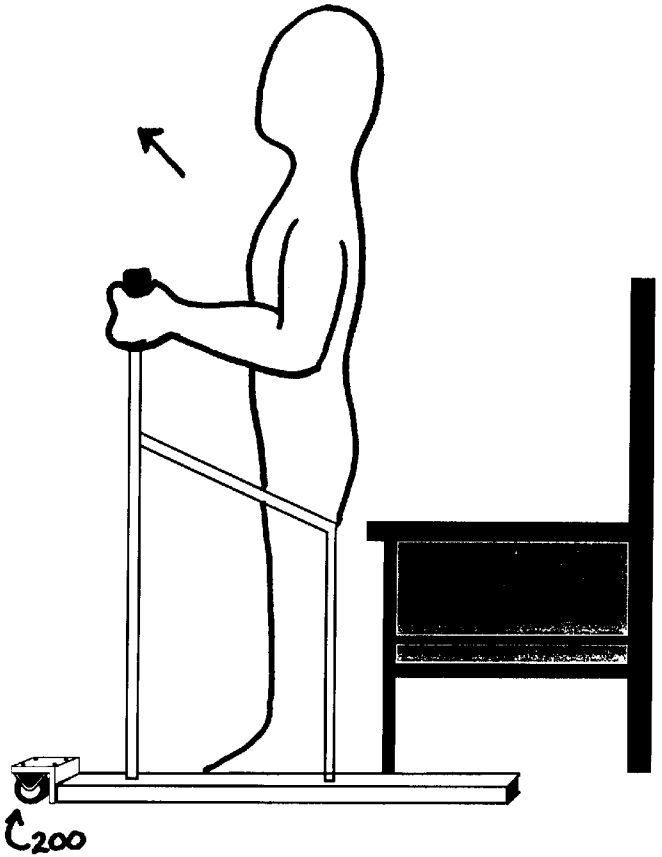
FIG. 18 is a side view illustrating the person utilizing the second embodiment of the device with the chair, the person rising from the chair.
Figure 21:
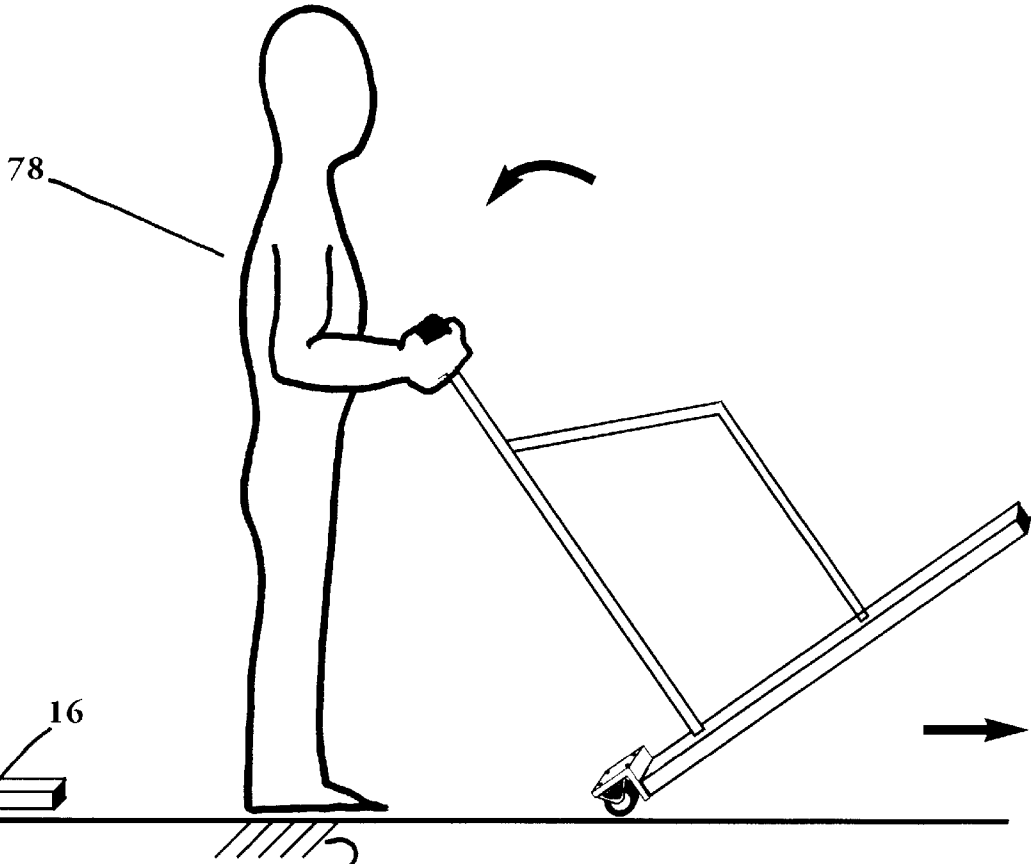
FIG. 21 is a side view illustrating the person utilizing the mobile wheel unit feature of the second embodiment to move the device.
Figure 20:
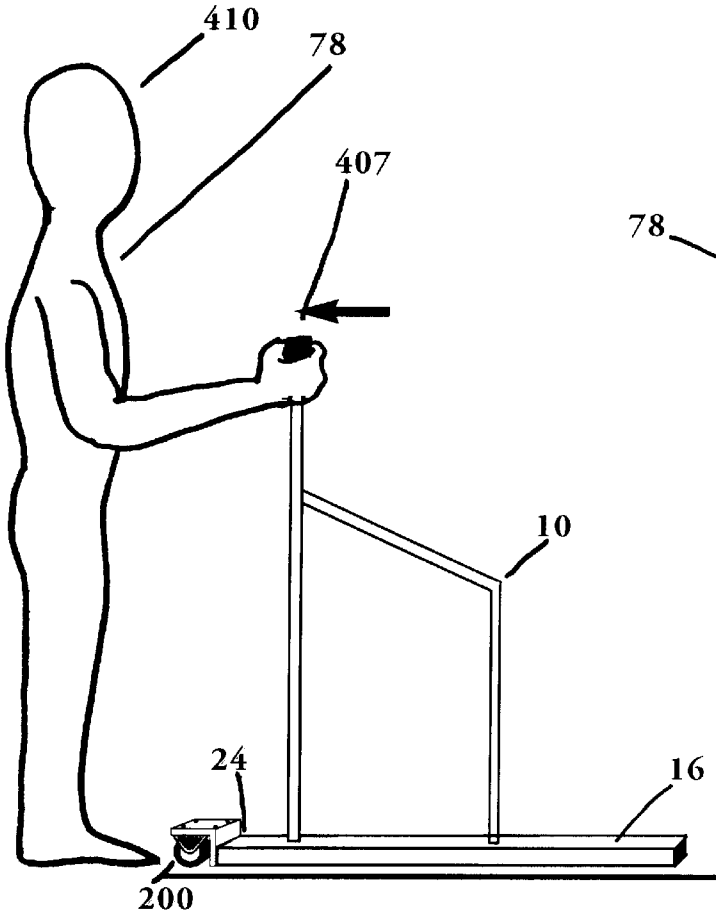
FIG. 20 is a side view illustrating the person utilizing the mobile wheel unit feature of the second embodiment to raise the device for moving.

To use the second embodiment, the mobile wheel unit 200 shown in FIGS. 18–21, the person 78 first steps on the floor surface 76 after rising to the standing position 410, as shown in FIGS. 18 and 19, and then stands forward of the device 10, in proximity and between the front ends 24 of the plurality of floor rail stabilizers 16 and 17, as shown in FIG. 20. The person 78 extends the hand 407 and grasps the vertical rail member 20 and 21 without stepping on the base platform 18. The person 78 then pulls back on the vertical rail member 20 and 21, lifting the back end 26 of the device 10 while pulling, and engages a plurality of casters 204 with the floor surface 76. Finally, the person 78 pushes the device 10, as shown by arrows in FIG. 21, while continually pulling on the vertical rail member 20 and 21 and rolls the device 10 across the floor surface 76 in any direction the person 78 chooses.

To use the third embodiment, the tray structure 300, as shown in FIG. 9, the person 78 removably places the tray support stand 302 on the corresponding vertical rail member 20 and 21 and a corresponding diagonally disposed rod member 22 and 23. The person 78 rests the tray support stand 302 on the first rod portion 114 of the corresponding diagonally disposed rod member 22 and 23 by inserting the tray support stand 302 around the corresponding vertical rail member 20 and 21 and the corresponding diagonally disposed rod member 22 and 23. Then the person 78 connects the tray support stand 302 with the tray support connector 344 after insertion. Finally, the person 78 removably places the tray 304 on the tray support stand 302 by inserting the block 354 attached to the tray 304 into the gap 342 created between the tray support stand 302 and the corresponding diagonally disposed rod member 22 and 23. This process can be performed in reverse manner to remove the tray structure 300. The tray structure 300 is designed for use preferrably with the first and second embodiments of my invention, although the tray stucture 300 is not to be limited to these embodiments.

Finally, the fifth embodiment is used in the same manner as the first embodiment However, as shown in FIGS. 22–26, the structure and construction of the fifth embodiment allows the person 78 clearance to move the foot 406 onto the base platform 18 by laterally swinging the foot 406 off of a bed 414 or from a side 417 of a dining room chair 416 from a first position 420, as shown in FIG. 26. The person 78 then laterally moves the foot 406 in sideways motion to a second position 422 onto the base platform 18, as shown in FIGS. 22, 24, and 26, without touching the vertical rail member 20 and 21 or the diagonally disposed rod member 22 and 23 because they are positioned forward of the base platform 18. The base platform 18 is narrower to allow the person to grasp the corresponding vertical rail member 20 and 21 with greater ease.

Figure 25:
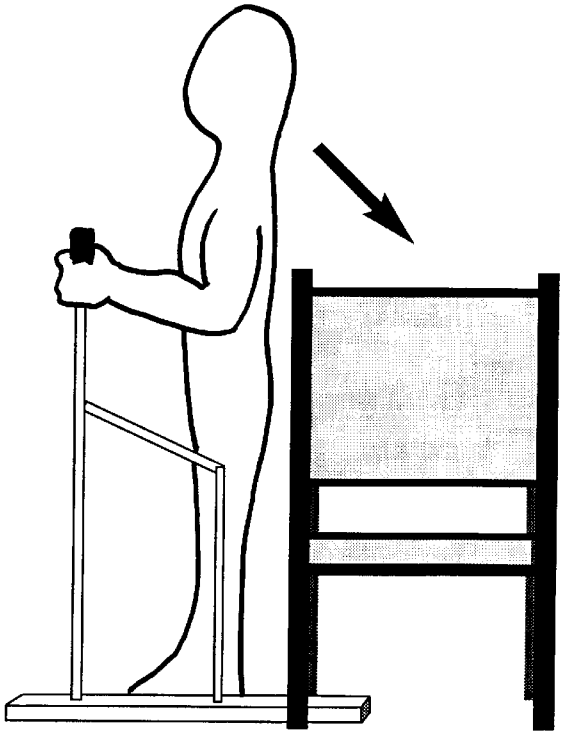
FIG. 25 is a side view illustrating the person utilizing the fifth embodiment of the device with the dining room chair, the person sitting on the dining room chair from the side.
Figure 26:
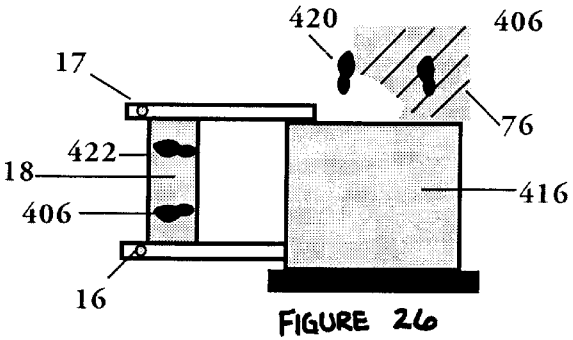
FIG. 26 is a plan view illustrating the person laterally swinging a foot from a first position on a floor surface to a second position on the base platform when using the fifth embodiment.

In use of all of the embodiments, the person 78 can position the device 10 with the back ends 26 of the plurality of floor rail stabilizers 16 and 17 underneath a chair 415, as shown in FIGS. 16–19, the bed 414, as shown in FIGS. 22 and 23, or the dining room chair 416, as shown in FIGS. 24 and 25. This positioning of the device 10 allows the base platform 18 to be located proximate the foot 406 so that the person 78 can step down on the device 10 for use of the device 10 in any of the embodiments, for comfort in grabbing the plurality of vertical rail members 20 and 21, and for proper rising or sitting motion so as to exercise the major muscle groups 408 and joints 409 by quick rising or sitting motions and prevent strain caused by slow movement. The device 10 thereby helps the person 78 to maintain mobility for a longer period of time. It is also contemplated that the device 10 can be used for stationary exercises such as walking-in-place or running-in-place while the person 78 continues to grasp the plurality of vertical rail members 20 and 21.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. In combination, a device resting on a floor surface for enhancing the self-mobility of a person comprising:

a base structure comprised of a plurality of floor rail stabilizers and a base platform, the plurality of floor rail stabilizers having parallel sides, the base platform comprised of a base frame and a base plate fixably attached to the base frame, the base frame having parallel side surfaces and being fixably attached in flush surface-to-surface relation to the plurality of floor rail stabilizers for strength and stability, the base platform being located and positioned between the plurality of floor rail stabilizers for holding the device to the floor surface while the person stands upon the base plate and then sits down or stands up, each floor rail stabilizer having a front end and a back end opposite and distal the front end, the base platform located proximate the front end and distal the back end to provide stability, leverage, and to resist tipping, the base structure providing a flat surface for ground engagement; and a plurality of upright side stands being sized and positioned on the base structure for sustaining and transferring a lateral force applied by the person, each upright side stand comprised of a plurality of vertical rail members and a plurality of angled rod members, each vertical rail member having a top end and a bottom end opposite the top end, each angled rod member comprising a first rod portion and a second rod portion connected to the first rod portion by a sharp rod bend, the first rod portion having a first rod end opposite the sharp rod bend, the second rod portion having a second rod end opposite the sharp rod bend, the first rod end located distal the second rod end, the sharp rod bend forming an obtuse angle between the first rod end and the second rod end, the obtuse angle having a value between 110 degrees and 150 degrees, the first rod end fixably attached to the corresponding vertical rail member proximate the top end, the first rod portion diagonally angled forming an acute angle between the first rod portion and the bottom end of the corresponding vertical rail member, the acute angle having a value between 30 degrees and 70 degrees, the second rod portion parallel to the corresponding vertical rail member, the bottom end and the second rod end being fixably and normally attached to the corresponding floor rail stabilizer in flush surface-to-surface relation to provide stability and strength, each upright side stand being located and positioned with each angled rod member positioned in a direction toward the back end of the corresponding floor rail stabilizer to provide stability, each vertical rail member thereby transferring the lateral force to the corresponding angled rod member, each angled rod member thereby transferring the lateral force to the corresponding floor rail stabilizer to resist tipping and to relieve the corresponding vertical rail member of stress.

2. The combination of claim 1, wherein the plurality of floor rail stabilizers and the base frame have substantially similar square and hollow uniform cross-sectioning to provide stability and flush surface-to-surface fitting for strength and rigidity, the plurality of upright side stands have substantially similar round and hollow uniform cross-sectioning to provide maximum strength and stability, the base structure and the plurality of upright side stands are constructed of solid steel for strength and rigidity, and each angled rod member has the round and hollow uniform cross-sectioning running lengthwise and is constructed of one-piece solid steel having the sharp rod bend in a mid portion.

3. The combination of claim 2, the device further comprising: each upright side stand being welded to the corresponding floor rail stabilizer in normal and flush surface-to-surface relation to provide maximum strength and stability, each upright side stand being located proximate the front end and distal the back end to provide maximum stability, the first rod end of the the first rod portion of each angled rod member being welded to the corresponding vertical rail member proximate the top end to provide maximum strength and stability, each floor rail stabilizer having a plurality of holes running through the parallel sides proximate the front end, the base frame comprising a plurality of long rails and a plurality of short rails welded to the plurality of long rails in normal and flush surface-to-surface relation for maximum strength and stability, the plurality of long rails running parallel to each other and running perpendicular to the plurality of short rails, the base frame having a rectangular shape and an upper face, each short rail having a plurality of connection holes, the base plate being welded to the upper face to provide strength and stability, each short rail fixably attached in flush surface-to-surface relation to the corresponding floor rail stabilizer by connectors inserted through the plurality of connection holes, into the plurality of holes, and welded to the corresponding floor rail stabilizer, the base platform being located and positioned between each upright side stand for maximum stability, a plug cap inserted into each front end and into each back end of the plurality of floor rail stabilizers, a hand grip attached to each top end of the plurality of vertical rail members, the base plate having a non-skid upper surface, the plurality of floor rail stabilizers having a non-skid bottom surface, the device being completely self-assisted.

4. The combination of claim 1, the device further comprising: a mobile wheel unit for moving and transporting the device on the floor surface, the mobile wheel unit comprising a plurality of angled brackets and a plurality of casters, each angled bracket being of rigid one-piece construction and having a 90 degree bend in a mid portion to allow for connections, each angled bracket fixably connected in flush surface-to-surface relation to the front end of the corresponding floor rail stabilizer, each angled bracket having a plurality of holes for connections, each caster connected to the angled bracket by the insertion of a plurality of short connectors through the plurality of holes, each caster positioned to lie flush with the flat surface of the base structure thereby resisting movement and ground engagement of the device when the person stands upon the base platform and allowing movement of the device when the person lifts up the back end of the corresponding floor rail stabilizer by pulling the vertical rail member when not standing on the base platform and pushing the device.

5. The combination of claim 1, the device further comprising: a tray structure comprised of a tray support stand and a tray operatively connected to the tray support stand, the tray support stand comprised of a plurality of angled tray support members, a plurality of tray support rails, and a plurality of tray support bars, each angled tray support member being of rigid one-piece construction and having a 90 degree bend in a central portion for support placement, each angled tray support member having a first edge and a second edge distal the first edge, each tray support rail comprising an uppermost face and a lowermost face parallel and opposite the uppermost face, an outermost face and an innermost face parallel and opposite the outermost face, and an outer end and an inner end opposite the outer end, the first edge of each angled tray support member fixably attached to the lowermost face proximate the outer end in flush surface-to-surface relation to provide strength and stability, the second edge of each angled tray support member fixably attached to the lowermost face proximate the inner end in flush surface-to-surface relation to provide strength and stability, each tray support bar comprising an inner face and an outer face opposite the inner face, and a first tip and a second tip opposite the first tip, the inner face proximate the first tip of one of the tray support bars being fixably attached in flush surface-to-surface relation to the outermost face of the tray support rail proximate the inner end to provide strength and stability, the inner face proximate the first tip of another one of the tray support bars being fixably attached in flush surface-to-surface relation to the innermost face of the tray support rail proximate the inner end to provide strength and stability, each tray support bar having a connecting hole proximate the second tip and passing through the inner face and the outer face, the tray support stand removably connected to the plurality of upright side stands by placement of each angled tray support on the first rod portion of the corresponding angled rod member, the tray support stand having a gap between the inner faces of the corresponding tray support bars for insertion around the plurality of upright side stands, the corresponding tray support bars connected by tray support connectors to secure the tray support stand to the plurality of upright side stands, the tray comprising an upper plane and a lower plane opposite the upper plane, a front edge and a back edge opposite the front edge, and a plurality of blocks, each block fixably attached to the lower plane proximate the back edge, the plurality of blocks spaced apart to allow each block to removably sit between the corresponding tray support bars in the gap to resist lateral movement of the tray, the lower plane resting on the uppermost face of each tray support rail in flush surface-to-surface relation for stability, the tray removably placed on the tray support stand.

6. The combination of claim 1, wherein the device is downsized proportionately to accomodate a child or small adult.

7. The combination of claim 1, wherein the device is used in a bedroom setting or a dining room setting, the base platform having a front portion running parallel to and being located proximate the corresponding front end of each floor rail stabilizer, the plurality of upright side stands being sized and positioned on the base structure between the corresponding front end of each floor rail stabilizer and the front portion of the base platform to allow the person clearance to laterally move a foot from a first position on the floor surface to a second position onto the base platform without touching the plurality of upright side stands.

8. The combination of claim 1, wherein the acute angle has a value of 45 degrees for maximum lateral force transfer, the obtuse angle has a value of 135 degrees.

9. A device resting on a floor surface for enhancing the self-mobility of a person comprising:

a plurality of floor rail stabilizers, each floor rail stabilizer having a front end, a back end opposite and distal the front end to provide stability, each floor rail stabilizer having parallel sides comprising a top side, a bottom side parallel and opposite the top side, the bottom side providing a bottom flat surface for ground engagement, an outer side, and an inner side parallel and opposite the outer side;

a plurality of vertical rail members, each vertical rail member having a top end and a bottom end opposite the top end, the bottom end fixably and normally attached in flush surface-to-surface relation to the top side of the corresponding floor rail stabilizer proximate the front end to provide maximum strength and stability, each vertical rail member being sized and positioned for sustaining and transferring a lateral force applied by the person;

a plurality of diagonally disposed rod members, the plurality of diagonally disposed rod members being of rigid construction and being sized and positioned for sustaining and transferring the lateral force, each diagonally disposed rod member comprising a first rod portion and a second rod portion connected to the first rod portion by a sharp rod bend, the first rod portion having a first rod end opposite the sharp rod bend, the second rod portion having a second rod end opposite the sharp rod bend, the first rod end distal the second rod end, the sharp rod bend forming an obtuse angle between the first rod end and the second rod end, the first rod end fixably attached to the corresponding vertical rail member proximate the top end, the obtuse angle having a value between 110 degrees and 150 degrees, the first rod portion diagonally angled forming an acute angle between the first rod portion and the bottom end of the corresponding vertical rail member and in a direction toward the back end of the corresponding floor rail stabilizer, the acute angle having a value between 30 degrees and 70 degrees, the second rod portion extending normally from the top side of the corresponding floor rail stabilizer, the second rod end fixably and normally attached in flush surface-to-surface relation to the top side proximate the back end to provide maximum stability and strength, each vertical rail member thereby transferring the lateral force to the corresponding diagonally disposed rod member, each diagonally disposed rod member thereby transferring the lateral force to the corresponding floor rail stabilizer to resist tipping and to relieve the corresponding vertical rail member of stress; and a base platform comprised of a base frame and a base plate fixably attached to the base frame, the base frame having a plurality of side surfaces, one of the side surfaces fixably attached in flush surface-to-surface relation to the inner side of each floor rail stabilizer to provide strength and stability, the base platform being located and positioned between the plurality of floor rail stabilizers for holding the device to the floor surface while the person stands upon the base plate and sits down or stands up, the base platform located proximate the front end and distal the back end of the plurality of floor rail stabilizers to provide stability, leverage, and to resist tipping.

10. The device of claim 9, wherein the plurality of floor rail stabilizers and the base frame have substantially similar square and hollow uniform cross-sectioning to provide stability and flush surface-to-surface fitting for strength and rigidity, the plurality of vertical rail members and the plurality of diagonally disposed rod members have substantially similar round and hollow uniform cross-sectioning to provide maximum strength and stability, the device being constructed of solid steel for strength and rigidity, and each diagonally disposed rod member has the round and hollow uniform cross-sectioning running lengthwise and is constructed of one-piece solid steel having the sharp rod bend in a mid portion.

11. The device of claim 10, further comprising: each vertical rail member and each diagonally disposed rod member being welded to the corresponding floor rail stabilizer in normal and flush surface-to-surface relation to provide maximum strength and stability, the first rod end of the the first rod portion of each diagonally disposed rod member being welded to the corresponding vertical rail member proximate the top end to provide maximum strength and stability, each floor rail stabilizer having a plurality of holes running through the outer side and the inner side, the plurality of holes proximate the front end, the base frame comprising a plurality of long rails and a plurality of short rails welded to the plurality of long rails in normal and flush surface-to-surface relation for maximum strength and stability, the plurality of long rails running parallel to each other and running perpendicular to the plurality of short rails, the base frame having a rectangular shape and an upper face, each short rail having a plurality of connection holes and a short rail surface, the base plate being welded to the upper face to provide strength and stability, the short rail surface being fixably attached in flush surface-to-surface relation to the corresponding floor rail stabilizer by connectors inserted through the plurality of connection holes, into the plurality of holes, and welded to the corresponding floor rail stabilizer, the base platform being located and positioned between each corresponding vertical rail member and each corresponding diagonally disposed rod member for maximum stability, a plug cap inserted into each front end and into each back end of the plurality of floor rail stabilizers, a hand grip attached to each top end of the plurality of vertical rail members, the base plate having a non-skid upper surface, the plurality of floor rail stabilizers having a non-skid bottom surface, the device being completely self-assisted.

12. The device of claim 11, further comprising: a mobile wheel unit for moving and transporting the device on the floor surface, the mobile wheel unit comprising a plurality of angled brackets and a plurality of casters, each angled bracket being of rigid one-piece steel construction and having a 90 degree bend in a mid portion to allow for connections, each angled bracket being fixably connected in flush surface-to-surface relation to the front end of the corresponding floor rail stabilizer, the plug cap being inserted only into the back end, each angled bracket having a plurality of holes for connections, each caster connected to the angled bracket by the insertion of a plurality of short connectors through the plurality of holes, each caster positioned to lie flush with the bottom flat surface of the corresponding floor rail stabilizer thereby resisting movement and ground engagement of the device when the person stands upon the base platform and allowing movement of the device when the person lifts up the back end of the corresponding floor rail stabilizer by pulling the vertical rail member when not standing on the base platform and pushing the device.

13. The device of claim 11, further comprising: a tray structure comprised of a tray support stand and a tray operatively connected to the tray support stand, the tray support stand comprised of a plurality of angled tray support members, a plurality of tray support rails, and a plurality of tray support bars, each angled tray support member being of rigid one-piece construction and having a 90 degree bend in a central portion for support placement, each angled tray support member having a first edge and a second edge distal the first edge, each tray support rail comprising an uppermost face and a lowermost face parallel and opposite the uppermost face, an outermost face and an innermost face parallel and opposite the outermost face, and an outer end and an inner end opposite the outer end, a plug cap inserted into the outer end, the first edge of each angled tray support member fixably attached to the lowermost face proximate the outer end in flush surface-to-surface relation to provide strength and stability, the second edge of each angled tray support member fixably attached to the lowermost face proximate the inner end in flush surface-to-surface relation to provide strength and stability, each tray support bar comprising an inner face and an outer face opposite the inner face, and a first tip and a second tip opposite the first tip, the inner face proximate the first tip of one of the tray support bars being fixably attached in flush surface-to-surface relation to the outermost face of the tray support rail proximate the inner end to provide strength and stability, the inner face proximate the first tip of another one of the tray support bars being fixably attached in flush surface-to-surface relation to the innermost face of the tray support rail proximate the inner end to provide strength and stability, each tray support bar having a connecting hole proximate the second tip and passing through the inner face and the outer face, the tray support stand removably connected to the plurality of vertical rail members and the plurality of diagonally disposed rod members by placement of each angled tray support on the first rod portion of the corresponding diagonally disposed rod member, the tray support stand having a gap between the inner faces of the corresponding tray support bars for insertion around the plurality of vertical rail members and the plurality of diagonally disposed rod members, the corresponding tray support bars connected by tray support connectors to secure the tray support stand to the plurality of vertical rail members and the plurality of diagonally disposed rod members, the tray comprising an upper plane and a lower plane opposite the upper plane, a front edge and a back edge opposite the front edge, and a plurality of blocks, each block fixably attached to the lower plane proximate the back edge, the plurality of blocks spaced apart to allow each block to removably sit between the corresponding tray support bars in the gap to resist lateral movement of the tray, the lower plane resting on the uppermost face of each tray support rail in flush surface-to-surface relation for stability, the tray removably placed on the tray support stand, the tray support stand being constructed of solid steel for strength and rigidity, the tray being constructed of fiber board having formica surfaces.

14. The device of claim 11, wherein the device is downsized proportionately to accomodate a child or small adult.

15. The device of claim 11, wherein the device is used in a bedroom setting or a dining room setting, the base platform having a front portion running parallel to and being located proximate the corresponding front end of each floor rail stabilizer, the plurality of vertical rail members and the plurality of diagonally disposed rod members being sized and positioned on the plurality of floor rail stabilizers between the corresponding front end of each floor rail stabilizer and the front portion of the base platform to allow the person clearance to laterally move a foot sideways from a first position on the floor surface to a second position onto the base platform without touching the plurality of vertical rail members and the plurality of diagonally disposed rod members, each of the plurality of long rails having a shorter dimension to narrow the base platform and to allow the person easier access to the hand grip.

16. The device of claim 11, wherein the acute angle has a value of 45 degrees for maximum lateral force transfer, the obtuse angle has a value of 135 degrees.

17. A method for enhancing the self-mobility of a person, the person having weight, at least one foot and hand, major muscle groups, and joints, the method comprising:

placing the foot on a base platform of a device by allowing the person to step through the device without impediment;

extending the hand and grasping a vertical rail member of the device;

pulling on the vertical rail member thereby transferring a lateral force from the hand to the vertical rail member;

rising to a standing position or sitting to a seated position while pulling on the vertical rail member thereby imparting the lateral force to the vertical rail member, shifting the weight to the base platform to hold the device on a floor surface, and exercising the hand, the foot, the major muscle groups and the joints in continuous motion without strain;

transferring the lateral force from the vertical rail member to a floor rail stabilizer by means of a diagonally disposed rod member thereby resisting tipping of the device and relieving the vertical rail member of stress; and releasing the grasp of the hand on the vertical rail member after rising to the standing position or sitting to a seated position and after attaining balance.

18. The method of claim 17, further comprising: stepping on the floor surface after rising to the standing position, standing forward of the device, extending the hand and grasping the vertical rail member without stepping on the base platform, pulling back on the vertical rail member, lifting a back end of the device while pulling, engaging a plurality of casters with the floor surface, pushing the device while continually pulling on the vertical rail member, and rolling the device across the floor surface.

19. The method of claim 17, further comprising: removably placing a tray support stand on the corresponding vertical rail member and a corresponding diagonally disposed rod member, resting the tray support stand on a first rod portion of the corresponding diagonally disposed rod member, inserting the tray support stand around and enclosing the corresponding vertical rail member and the corresponding diagonally disposed rod member, connecting the tray support stand with a tray support connector after insertion, removably placing a tray on the tray support stand by inserting a block attached to the tray into a gap created between the tray support stand and the corresponding diagonally disposed rod member.

20. The method of claim 17, further comprising: sitting on a bed or on a dining room chair, laterally swinging the foot off of the bed or from a side of the dining room chair from a first position, laterally moving the foot in sideways motion to a second position onto the base platform without touching the vertical rail member or the diagonally disposed member.

21. In combination, a device resting on a floor surface for enhancing the self-mobility of a person comprising:

a base structure comprised of a plurality of floor rail stabilizers and a base platform, the plurality of floor rail stabilizers having parallel sides, the base platform comprised of a base frame and a base plate fixably attached to the base frame, the base frame having parallel side surfaces and being fixably attached in flush surface-to-surface relation to the plurality of floor rail stabilizers for strength and stability, the base platform being located and positioned between the plurality of floor rail stabilizers for holding the device to the floor surface while the person stands upon the base plate and then sits down or stands up, each floor rail stabilizer having a front end and a back end opposite and distal the front end, the base platform located proximate the front end and distal the back end to provide stability, leverage, and to resist tipping, the base structure providing a flat surface for ground engagement;

a plurality of upright side stands being sized and positioned on the base structure for sustaining and transferring a lateral force applied by the person, each upright side stand comprised of a plurality of vertical rail members and a plurality of angled rod members, each vertical rail member having a top end and a bottom end opposite the top end, each angled rod member comprising a first rod portion and a second rod portion connected to the first rod portion by a sharp rod bend, the first rod portion having a first rod end opposite the sharp rod bend, the second rod portion having a second rod end opposite the sharp rod bend, the first rod end located distal the second rod end, the sharp rod bend forming an obtuse angle between the first rod end and the second rod end, the obtuse angle having a value between 110 degrees and 150 degrees, the first rod end fixably attached to the corresponding vertical rail member proximate the top end, the first rod portion diagonally angled forming an acute angle between the first rod portion and the bottom end of the corresponding vertical rail member, the acute angle having a value between 30 degrees and 70 degrees, the second rod portion parallel to the corresponding vertical rail member, the bottom end and the second rod end being fixably and normally attached to the corresponding floor rail stabilizer in flush surface-to-surface relation to provide stability and strength, each upright side stand being located and positioned with each angled rod member positioned in a direction toward the back end of the corresponding floor rail stabilizer to provide stability, each vertical rail member thereby transferring the lateral force to the corresponding angled rod member, each angled rod member thereby transferring the lateral force to the corresponding floor rail stabilizer to resist tipping and to relieve the corresponding vertical rail member of stress; and a tray structure comprised of a tray support stand and a tray operatively connected to the tray support stand, the tray support stand comprised of a plurality of angled tray support members, a plurality of tray support rails, and a plurality of tray support bars, each angled tray support member being of rigid one-piece construction and having a 90 degree bend in a central portion for support placement, each angled tray support member having a first edge and a second edge distal the first edge, each tray support rail comprising an uppermost face and a lowermost face parallel and opposite the uppermost face, an outermost face and an innermost face parallel and opposite the outermost face, and an outer end and an inner end opposite the outer end, the first edge of each angled tray support member fixably attached to the lowermost face proximate the outer end in flush surface-to-surface relation to provide strength and stability, the second edge of each angled tray support member fixably attached to the lowermost face proximate the inner end in flush surface-to-surface relation to provide strength and stability, each tray support bar comprising an inner face and an outer face opposite the inner face, and a first tip and a second tip opposite the first tip, the inner face proximate the first tip of one of the tray support bars being fixably attached in flush surface-to-surface relation to the outermost face of the tray support rail proximate the inner end to provide strength and stability, the inner face proximate the first tip of another one of the tray support bars being fixably attached in flush surface-to-surface relation to the innermost face of the tray support rail proximate the inner end to provide strength and stability, each tray support bar having a connecting hole proximate the second tip and passing through the inner face and the outer face, the tray support stand removably connected to the plurality of upright side stands by placement of each angled tray support on the first rod portion of the corresponding angled rod member, the tray support stand having a gap between the inner faces of the corresponding tray support bars for insertion around the plurality of upright side stands, the corresponding tray support bars connected by tray support connectors to secure the tray support stand to the plurality of upright side stands, the tray comprising an upper plane and a lower plane opposite the upper plane, a front edge and a back edge opposite the front edge, and a plurality of blocks, each block fixably attached to the lower plane proximate the back edge, the plurality of blocks spaced apart to allow each block to removably sit between the corresponding tray support bars in the gap to resist lateral movement of the tray, the lower plane resting on the uppermost face of each tray support rail in flush surface-to-surface relation for stability, the tray removably placed on the tray support stand.

22. A device resting on a floor surface for enhancing the self-mobility of a person comprising:

a plurality of floor rail stabilizers, each floor rail stabilizer having a front end, a back end opposite and distal the front end to provide stability, each floor rail stabilizer having parallel sides comprising a top side, a bottom side parallel and opposite the top side, the bottom side providing a bottom flat surface for ground engagement, an outer side, and an inner side parallel and opposite the outer side, each floor rail stabilizer having a plurality of holes running through the outer side and the inner side, the plurality of holes being proximate the front end, the plurality of floor rail stabilizers having a non-skid bottom surface;

a plurality of vertical rail members, each vertical rail member having a top end and a bottom end opposite the top end, the bottom end fixably and normally attached in flush surface-to-surface relation to the top side of the corresponding floor rail stabilizer proximate the front end to provide maximum strength and stability, each vertical rail member being sized and positioned for sustaining and transferring a lateral force applied by the person, a hand grip being attached to each top end of the plurality of vertical rail members;

a plurality of diagonally disposed rod members, the plurality of diagonally disposed rod members being of rigid construction and being sized and positioned for sustaining and transferring the lateral force, each diagonally disposed rod member comprising a first rod portion and a second rod portion connected to the first rod portion by a sharp rod bend, the first rod portion having a first rod end opposite the sharp rod bend, the second rod portion having a second rod end opposite the sharp rod bend, the first rod end distal the second rod end, the sharp rod bend forming an obtuse angle between the first rod end and the second rod end, the first rod end fixably attached to the corresponding vertical rail member proximate the top end, the obtuse angle having a value between 110 degrees and 150 degrees, the first rod portion diagonally angled forming an acute angle between the first rod portion and the bottom end of the corresponding vertical rail member and in a direction toward the back end of the corresponding floor rail stabilizer, the acute angle having a value between 30 degrees and 70 degrees, the second rod portion extending normally from the top side of the corresponding floor rail stabilizer, the second rod end fixably and normally attached in flush surface-to-surface relation to the top side proximate the back end to provide maximum stability and strength, each vertical rail member thereby transferring the lateral force to the corresponding diagonally disposed rod member, each diagonally disposed rod member thereby transferring the lateral force to the corresponding floor rail stabilizer to resist tipping and to relieve the corresponding vertical rail member of stress, the plurality of vertical rail members and the plurality of diagonally disposed rod members having substantially similar round and hollow uniform cross-sectioning to provide maximum strength and stability, each diagonally disposed rod member having the round and hollow uniform cross-sectioning running lengthwise and being constructed of one-piece solid steel having the sharp rod bend in a mid portion, each vertical rail member and each diagonally disposed rod member being welded to the corresponding floor rail stabilizer in normal and flush surface-to-surface relation to provide maximum strength and stability, the first rod end of the first rod portion of each diagonally disposed rod member being welded to the corresponding vertical rail member being proximate the top end to provide maximum strength and stability;

a base platform comprised of a base frame and a base plate fixably attached to the base frame, the base frame having a plurality of side surfaces, one of the side surfaces fixably attached in flush surface-to-surface relation to the inner side of each floor rail stabilizer to provide strength and stability, the base platform being located and positioned between the plurality of floor rail stabilizers for holding the device to the floor surface while the person stands upon the base plate and sits down or stands up, the base platform located proximate the front end and distal the back end of the plurality of floor rail stabilizers to provide stability, leverage, and to resist tipping, the plurality of floor rail stabilizers and the base frame having substantially similar square and hollow uniform cross-sectioning to provide stability and flush surface-to-surface fitting for strength and rigidity, the base frame comprising a plurality of long rails and a plurality of short rails welded to the plurality of long rails in normal and flush surface-to-surface relation for maximum strength and stability, the plurality of long rails running parallel to each other and running perpendicular to the plurality of short rails, the base frame having a rectangular shape and an upper face, each short rail having a plurality of connection holes and a short rail surface, the base plate being welded to the upper face to provide strength and stability, the short rail surface being fixably attached in flush surface-to-surface relation to the corresponding floor rail stabilizer by connectors inserted through the plurality of connection holes, into the plurality of holes, and welded to the corresponding floor rail stabilizer, the base platform being located and positioned between each corresponding vertical rail member and each corresponding diagonally disposed rod member for maximum stability, a plug cap inserted into each front end and into each back end of the plurality of floor rail stabilizers, the base plate having a non-skid upper surface; and a tray structure comprised of a tray support stand and a tray operatively connected to the tray support stand, the tray support stand comprised of a plurality of angled tray support members, a plurality of tray support rails, and a plurality of tray support bars, each angled tray support member being of rigid one-piece construction and having a 90 degree bend in a central portion for support placement, each angled tray support member having a first edge and a second edge distal the first edge, each tray support rail comprising an uppermost face and a lowermost face parallel and opposite the uppermost face, an outermost face and an innermost face parallel and opposite the outermost face, and an outer end and an inner end opposite the outer end, a plug cap inserted into the outer end, the first edge of each angled tray support member fixably attached to the lowermost face proximate the outer end in flush surface-to-surface relation to provide strength and stability, the second edge of each angled tray support member fixably attached to the lowermost face proximate the inner end in flush surface-to-surface relation to provide strength and stability, each tray support bar comprising an inner face and an outer face opposite the inner face, and a first tip and a second tip opposite the first tip, the inner face proximate the first tip of one of the tray support bars being fixably attached in flush surface-to-surface relation to the outermost face of the tray support rail proximate the inner end to provide strength and stability, the inner face proximate the first tip of another one of the tray support bars being fixably attached in flush surface-to-surface relation to the innermost face of the tray support rail proximate the inner end to provide strength and stability, each tray support bar having a connecting hole proximate the second tip and passing through the inner face and the outer face, the tray support stand removably connected to the plurality of vertical rail members and the plurality of diagonally disposed rod members by placement of each angled tray support on the first rod portion of the corresponding diagonally disposed rod member, the tray support stand having a gap between the inner faces of the corresponding tray support bars for insertion around the plurality of vertical rail members and the plurality of diagonally disposed rod members, the corresponding tray support bars connected by tray support connectors to secure the tray support stand to the plurality of vertical rail members and the plurality of diagonally disposed rod members, the tray comprising an upper plane and a lower plane opposite the upper plane, a front edge and a back edge opposite the front edge, and a plurality of blocks, each block fixably attached to the lower plane proximate the back edge, the plurality of blocks spaced apart to allow each block to removably sit between the corresponding tray support bars in the gap to resist lateral movement of the tray, the lower plane resting on the uppermost face of each tray support rail in flush surface-to-surface relation for stability, the tray removably placed on the tray support stand, the tray support stand being constructed of solid steel for strength and rigidity, the tray being constructed of fiber board having formica surfaces, the device being completely self-assisted and being constructed of solid steel for strength and rigidity.

23. A method for enhancing the self-mobility of a person, the person having weight, at least one foot and hand, major muscle groups, and joints, the method comprising:

placing the foot on a base platform of a device by allowing the person to step through the device without impediment;

extending the hand and grasping a vertical rail member of the device;

pulling on the vertical rail member thereby transferring a lateral force from the hand to the vertical rail member;

rising to a standing position or sitting to a seated position while pulling on the vertical rail member thereby imparting the lateral force to the vertical rail member, shifting the weight to the base platform to hold the device on a floor surface, and exercising the hand, the foot, the major muscle groups and the joints in continuous motion without strain;

transferring the lateral force from the vertical rail member to a floor rail stabilizer by means of a diagonally disposed rod member thereby resisting tipping of the device and relieving the vertical rail member of stress;

releasing the grasp of the hand on the vertical rail member after rising to the standing position or sitting to a seated position and after attaining balance;

removably placing a tray support stand on the corresponding vertical rail member and a corresponding diagonally disposed rod member;

resting the tray support stand on a first rod portion of the corresponding diagonally disposed rod member;

inserting the tray support stand around and enclosing the corresponding vertical rail member and the corresponding diagonally disposed rod member;

connecting the tray support stand with a tray support connector after insertion; and removably placing a tray on the tray support stand by inserting a block attached to the tray into a gap created between the tray support stand and the corresponding diagonally disposed rod member.

* * * * *